US008814598B2

(12) United States Patent
Hein et al.

(10) Patent No.: US 8,814,598 B2
(45) Date of Patent: Aug. 26, 2014

(54) CONTACT MEANS FOR ATTACHING AN END OF A SHIELDED CABLE

(75) Inventors: Stefan Hein, Bensheim (DE); Martin Szelag, Bickenbach (DE); Karl-Heinz Hess, Heppenheim (DE); Martin Schmitt, Heidelberg (DE); Dennis Feldmann, Oberusel (DE); Hermann Schenk, Wiesendorf (DE); Achim Pfeffer, Bonn (DE); Thomas Gerlach, Darmstadt (DE); Niranjan Thirunavukkarasu, Neu-Isenberg (DE)

(73) Assignee: Tyco Electronics AMP GmbH, Bensheim (DE)

( * ) Notice: Subject to any disclaimer, the term of this patent is extended or adjusted under 35 U.S.C. 154(b) by 63 days.

(21) Appl. No.: 13/580,366

(22) PCT Filed: Feb. 14, 2011

(86) PCT No.: PCT/EP2011/052116

§ 371 (c)(1),
(2), (4) Date: Aug. 21, 2012

(87) PCT Pub. No.: WO2011/101308

PCT Pub. Date: Aug. 25, 2011

(65) Prior Publication Data

US 2012/0315790 A1 Dec. 13, 2012

(30) Foreign Application Priority Data

Feb. 22, 2010 (DE) ..... 10 2010 002 176

(51) Int. Cl.
*H01R 9/03* (2006.01)

(52) U.S. Cl.
USPC ..... 439/607.41; 439/455

(58) Field of Classification Search
USPC ..... 439/607.41, 607.47, 607.5, 607.52, 439/455, 465, 574
See application file for complete search history.

(56) References Cited

U.S. PATENT DOCUMENTS 4,840,581 A * 6/1989 Leufert et al. ..... 439/472
4,963,104 A 10/1990 Dickie (Continued)

FOREIGN PATENT DOCUMENTS

EP 1914844 A2 4/2008
FR 2740920 A1 5/1997

OTHER PUBLICATIONS

International Preliminary Report on Patentability issued by The International Bureau of WIPO, Geneva, Switzerland, dated Aug. 28, 2012, for related International Application No. PCT/EP2011/052116; 4 pages.

(Continued)

*Primary Examiner* — Xuong Chung Trans
(74) *Attorney, Agent, or Firm* — Faegre Baker Daniels LLP

(57) ABSTRACT

The invention relates to a contact means (100) for attaching an end of a cable (110). The contact means (100) has a casing (300) with an inner chamber (320) for receiving a section of the cable (110) in the region of the cable end, and a pull relief element (200, 201, 202, 203) which can be fastened to the casing (300) in the inner chamber (320), with a pull relief section (220, 221, 222, 223) and at least one contacting section (240, 241). The pull relief section (220, 221, 222, 223) is formed to fix a cable sheath (120) of the cable (110). The contacting section (240, 241) is formed to contact a shield (130) of the cable (110).

14 Claims, 18 Drawing Sheets

(56) References Cited

U.S. PATENT DOCUMENTS

Figure 1:
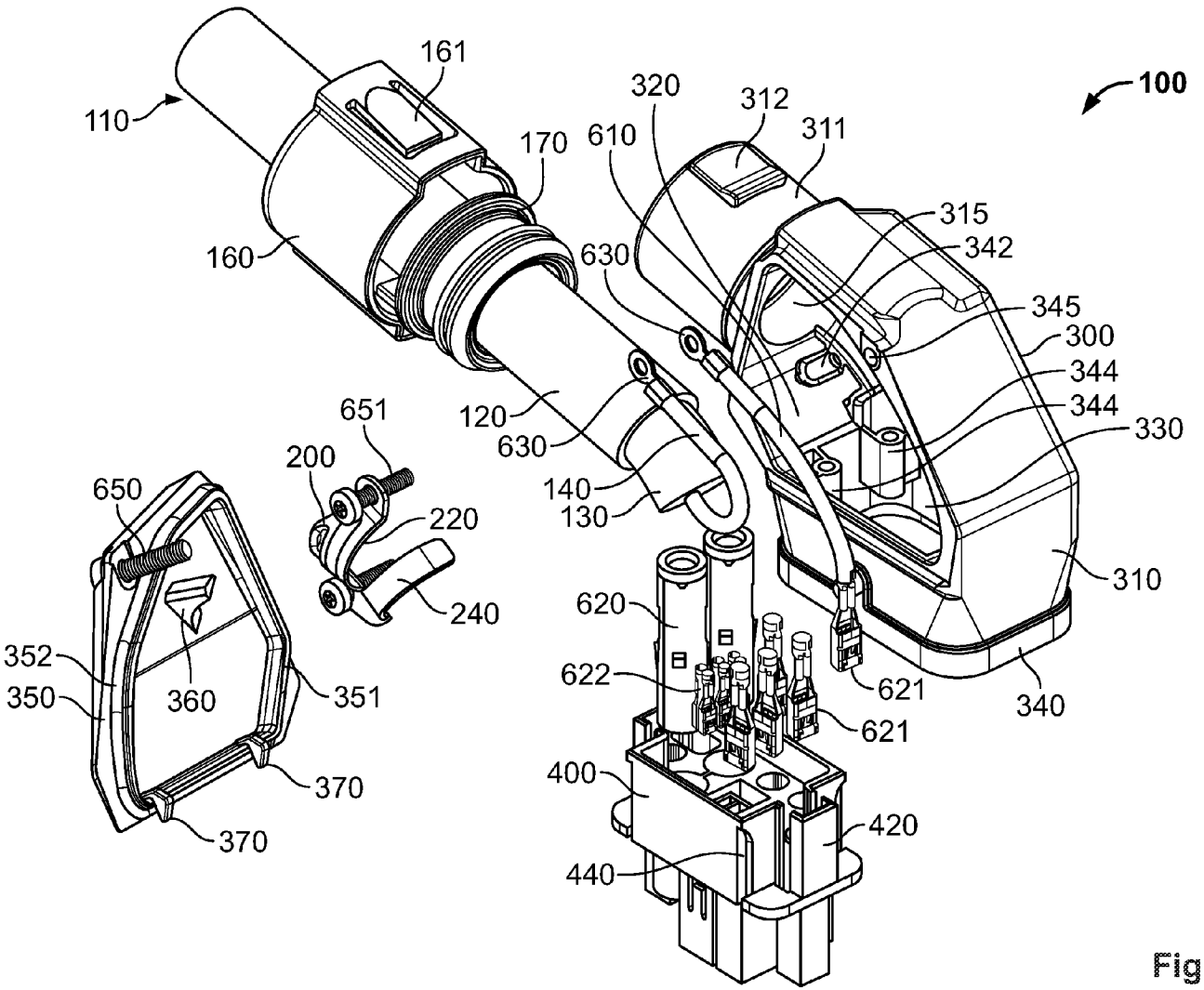

| | | | | |
|---|---|---|---|---|
| 5,178,559 | A * | 1/1993 | Mello | 439/472 |
| 5,466,175 | A * | 11/1995 | Onoda | 439/607.48 |
| 5,620,334 | A * | 4/1997 | Quillet et al. | 439/471 |
| 6,106,325 | A * | 8/2000 | Kuo | 439/455 |
| 7,972,172 | B2 * | 7/2011 | Huang et al. | 439/578 |

OTHER PUBLICATIONS

International Search Report and Written Opinion issued by the European Patent Office, dated Apr. 13, 2011, for related International Application No. PCT/EP2011/052116; 8 pages.

* cited by examiner

CONTACT MEANS FOR ATTACHING AN END OF A SHIELDED CABLE

The present invention relates to a contact means for attaching one end of a cable, and also to a cable with such a contact means.

Cables are used to transmit power for supplying power or voltage and also to transmit data. Combined applications, in which energy is supplied and data transferred simultaneously via one and the same cable, are also possible. One example is the decentralised control of motors in the industrial field, in which cables are used both for transmitting control signals and for supplying power or voltage to the motors.

Cables used for such combined applications have a plurality of lines which are enveloped, for example in circular manner, by an insulator, what is called the sheath. The individual lines, which are also referred to as cores, are usually surrounded by their own insulator, the core insulation, while the cable sheath envelops all the lines. Further, a further insulation which surrounds the lines and, adjoining the cable sheath, a shield may be provided between the cable sheath and the lines. The shield, which may be in the form of a wire braid or mesh, serves to guarantee the electromagnetic compatibility (EMC) of the cable. The individual lines may also have their own shield, for example in the form of a shield braid.

Known cables further have at their cable ends contact means, which are also referred to as plugs or connectors. Such a connector is formed to be fitted together with a complementary connector mating part, by means of which the cables can be connected to other devices such as for example printed circuit boards. The contact means comprise a plurality of contact elements which are connected to the lines of a cable. The contact elements may be in the form of male and female contact elements, which are also referred to as contact pins or female contacts, respectively.

In addition to contact elements, conventional contact means further have a metal casing with an inner chamber in which a section of a cable is received in the region of the cable end and lines of the cable are connected to the contact elements. In addition to protection from external influences such as for example splashes and dirt, the casing is used to permit shielding of the cable in the region of the cable end. To this end, the casing is attached electrically to the shield of the cable. Further, usually a pull relief means is realised on the casing in order to protect the connection between the lines of the cable and contact elements of the contact means from mechanical stress.

For the purpose of pull relief and shield contacting, known motor plugs used in the industrial field have a plurality of components and clamping parts which can be screwed to a casing part. These are formed to clamp the sheath of a cable or to cut into the sheath, bringing about pull relief. Also, contacting of the shield through the cable sheath is made possible in order to produce an electrical connection between the shield and the casing.

Using a plurality of components which have to be screwed [together] for relieving pull and shield contacting entails difficult and expensive assembly of the contact means. Also, some of the components used are shaped parts, which are produced by means of a turning operation and consequently in a relatively costly manner. The contacting of the cable shield is carried out with the aid of sharply tapering structural elements or pins which penetrate the sheath of the cable in question. With such a penetration technique, also referred to as "piercing", there may for example be the problem that a piercing tip adjoins only a few wires of the shield braid, which is associated with poor contacting. Severing of a wire or a wire strand of the shield mesh is also possible.

The object of the invention is to provide an improved solution for a contact means for attaching an end of a cable which offers advantages such as in particular simplified, more inexpensive, assembly, while at the same time having increased production quality.

This object is achieved by a contact means according to Claim 1 and by a cable with a contact means according to Claim 14. Further advantageous embodiments of the invention are set forth in the dependent claims.

According to the invention, a contact means for attaching an end of a cable is proposed. The contact means has a casing with an inner chamber for receiving a section of the cable in the region of the cable end, and a pull relief element which can be fastened to the casing in the inner chamber. The pull relief element has a pull relief section and at least one contacting section. The pull relief section is formed to fix a cable sheath of the cable. The contacting section is formed to contact a shield of the cable.

With the contact means according to the invention, provision is made for the pull relief and the shield contacting to be realised (merely) with the aid of the pull relief element. Compared with the use described above of a plurality of components which have to be screwed together, in this manner relatively simple and time-saving attachment of the contact means to the cable is made possible. The casing in this case can be reliably electrically connected to the shield via the pull relief element which is fastened to the casing and contacts the shield. Furthermore, the pull relief element can be produced in an inexpensive manner, which means that the use of the contact means entails relatively low costs.

In a preferred embodiment, the pull relief section of the pull relief element can be fastened to the casing at two fastening points in order partially to encompass the cable which is provided between the fastening points by the pull relief section. In this configuration, the cable may be surrounded by the pull relief section in a partial circumference, by means of which relatively stable pull relief can be realised.

In a further preferred embodiment, the pull relief section of the pull relief element is formed to clamp in the cable sheath of the cable and/or to cut into the cable sheath. With regard to cutting into the cable sheath, provision may further be made for the pull relief section also to contact the shield (arranged beneath the sheath) of the cable, by means of which the shield contacting can possibly be improved.

In a further preferred embodiment, the contacting section of the pull relief element is formed to lie on an exposed region of the shield of the cable. In this manner, two-dimensional and hence effective contacting of the shield can be made possible. Problems of a "piercing" connection technique, such as for example poor contacting of the shield, can thereby be avoided.

In a further preferred embodiment, the casing has a structural element in the inner chamber by means of which the contacting section of the pull relief element can be pressed against an exposed region of the shield of the cable. In this manner, the contacting of the shield by the pull relief element can be improved further.

In a further preferred embodiment, provision is made for the casing to have an access opening for the cable on the inner chamber, and for the pull relief element to have a section which is formed to lie against a casing wall, which surrounds the access opening, of the casing. This means that the access opening, or a gap between the cable and an edge region of the access opening, can be substantially closed, which may prove advantageous for efficient shielding of the inner chamber.

In a further preferred embodiment, the casing has a casing base part and a casing cover. The casing base part comprises the inner chamber and has a casing opening which exposes the inner chamber. Therein, the inner chamber of the casing base part can be closed by the casing cover. In such a configuration, simple and time-saving assembly of the contact means is made possible. Also, the casing opening can be used for visual checking during the assembly.

The casing or the casing components thereof may be realised in different forms. One possible example is an angled casing form. In this case, the casing base part preferably has a form which is widened in the direction of exit of the cable, so that the cable can be curved in as large a radius as possible in the inner chamber. This is in particular advantageous with regard to attachment of the contact means to a cable which is relatively resistant to bending.

In a further preferred embodiment, the casing cover has a pressure-application structure which is formed to press the contacting section of the pull relief element, when the inner chamber is closed, against an exposed region of the shield of the cable. In this manner too, the contacting of the shield by the pull relief element can be improved further. Furthermore, reliable contacting of the shield can be achieved even with varying cables with different cable diameters.

In a further preferred embodiment, the contact means has a contact insert and at least one contact element which can be arranged in the contact insert and can be connected to a line of the cable. The casing base part has a contact-insert region with an opening for arranging the contact insert. The casing cover has claw-shaped holding elements, by means of which the casing cover can be fastened to an edge when closing the inner chamber. Furthermore, the contact insert has cut-outs into which the claw-shaped holding elements of the casing cover can be engaged upon the fastening, in order to fasten the contact insert to the casing base part. In this configuration, the fastening of the contact insert can be carried out in a relatively simple manner.

In a further preferred embodiment, the contact means has a contact insert, a first contact element which can be arranged in the contact element and a second contact element which can be connected to a line. The first and second contact elements can be plugged into one another to produce an electrical connection. The first contact element further has a central contact section and two resilient contact sections arranged laterally from the central contact section. In such a configuration, provision may be made for contacting between the first and second contact elements to take place not only via the central, but also via the resilient contact sections, which may entail a relatively low contact resistance.

With regard to the line to which the second contact element can be connected, preferably an additional line is considered which is provided for connection to a protective conductor of the cable via the pull relief element. In this manner, the protective conductor of the cable can be electrically connected to the shield and the casing via the pull relief element. A connection of the protective conductor can be brought outwards via the additional line and the first and second contact element.

In an alternative configuration, the line to which the second contact element can be connected may also be a protective conductor of the cable. In this case, the protective conductor can be electrically connected to the shield in a different manner, for example with the aid of the configuration described below.

In a further preferred embodiment, the contact insert has a receiving region for the first contact element. The receiving region has cut-outs through which the resilient contact sections of the first contact element which is arranged in the receiving region partially project out, so that the resilient contact sections contact the casing when the contact insert is arranged on the casing. By means of this, the protective conductor connected to the second contact element can be connected to the shield of the cable via the first contact element, the casing and the pull relief element.

In a further preferred embodiment, the contact insert has one receiving region for the first contact element on two sides in each case. By means of this, the contact insert can be used flexibly for contact arrangements which are symmetrical to one another.

According to the invention, furthermore a cable is proposed which has a cable sheath, a shield and a contact means for attaching an end of the cable according to one of the configurations described above. In this case, the contact means can be arranged on the cable in a simple and time-saving manner. Also the use of the contact means involves low costs.

In a preferred embodiment, the cable has a protective conductor which is electrically connected to the shield of the cable. The electrical connection between the protective conductor and shield can take place via the pull relief element and/or the first and second contact element (arranged in the contact insert), the casing and the pull relief element. The electrical connection between the protective conductor and shield for example offers the possibility of optionally improving protective switching-off carried out with the aid of the protective conductor.

Figure 2:
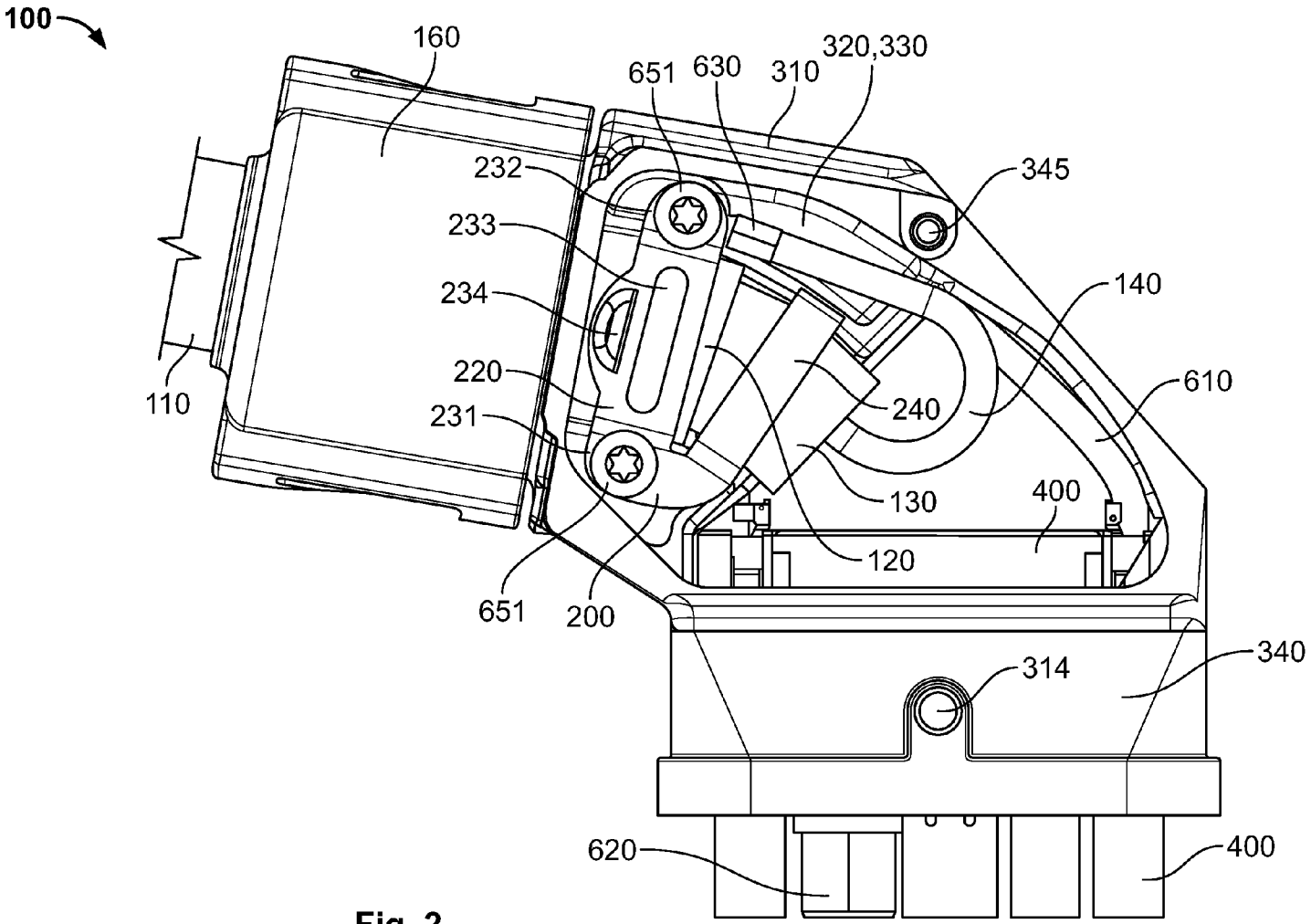
Figure 3:
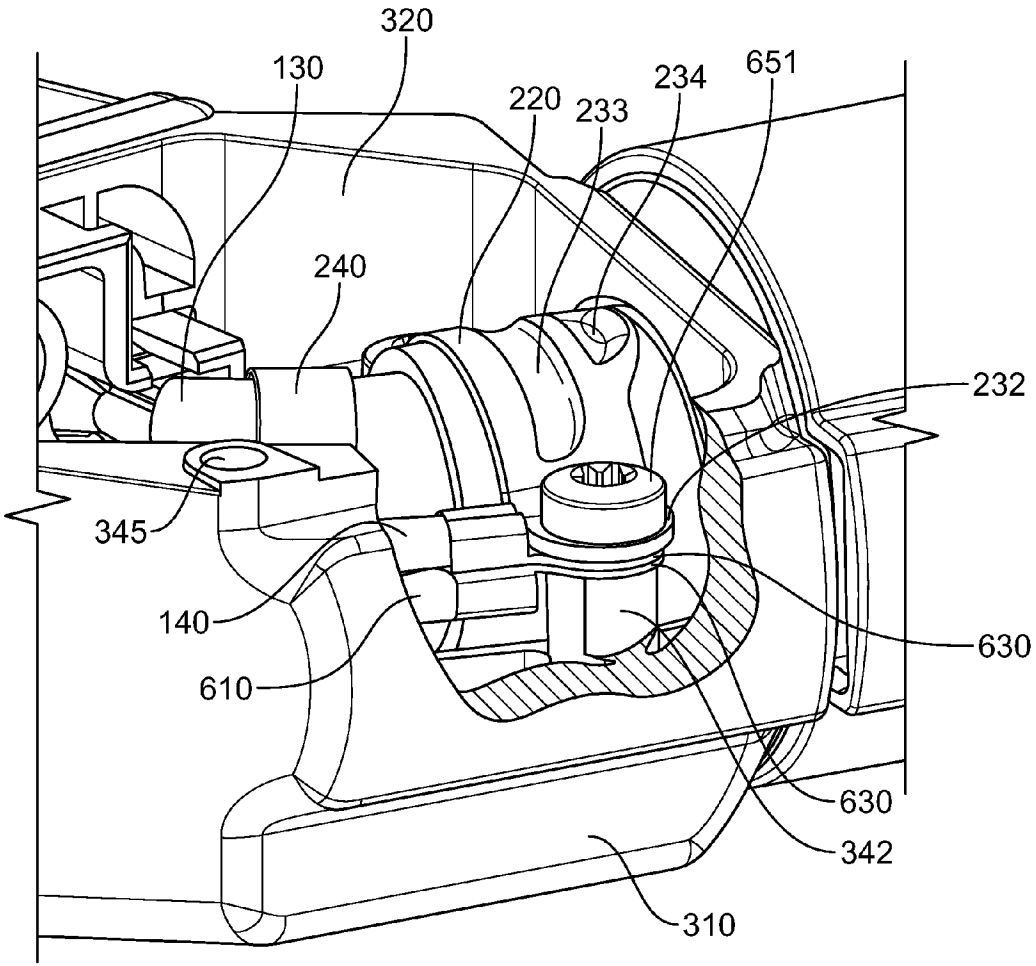
Figure 4:
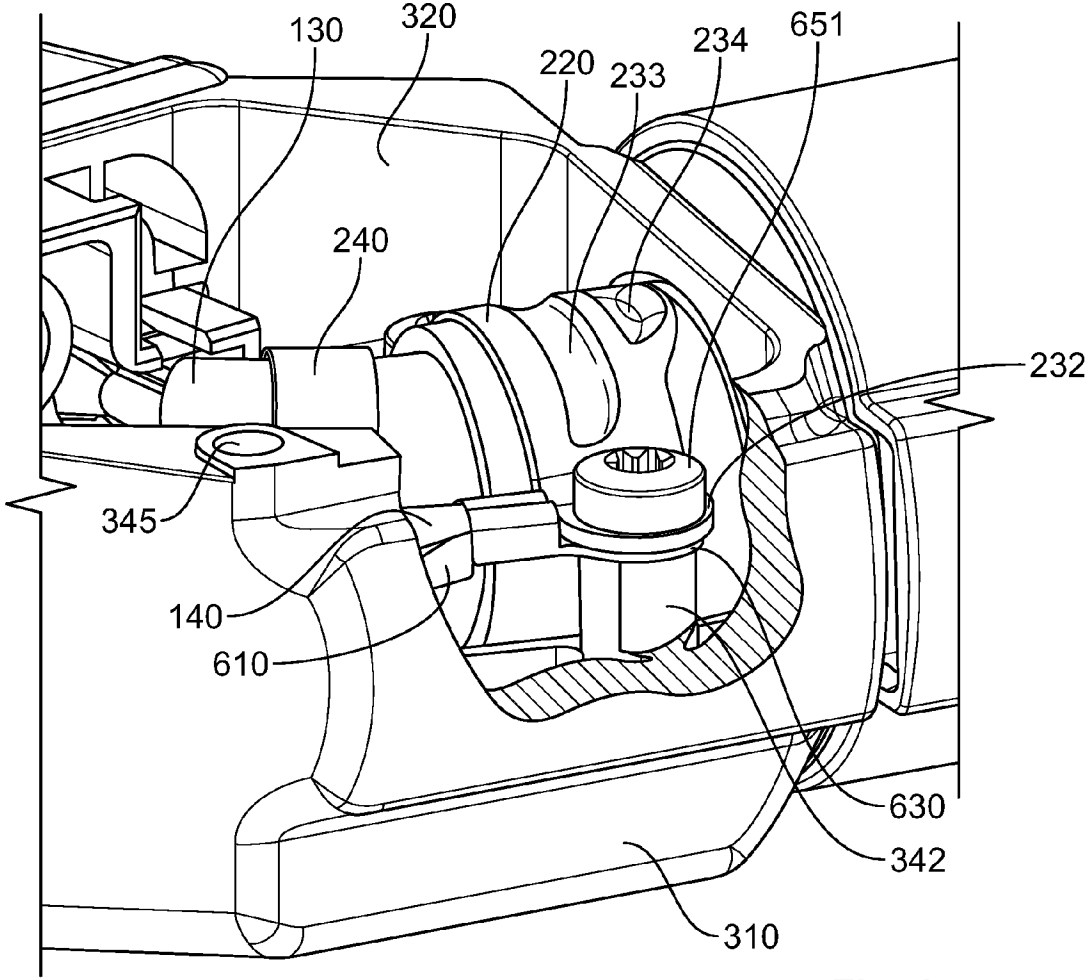
Figure 5:
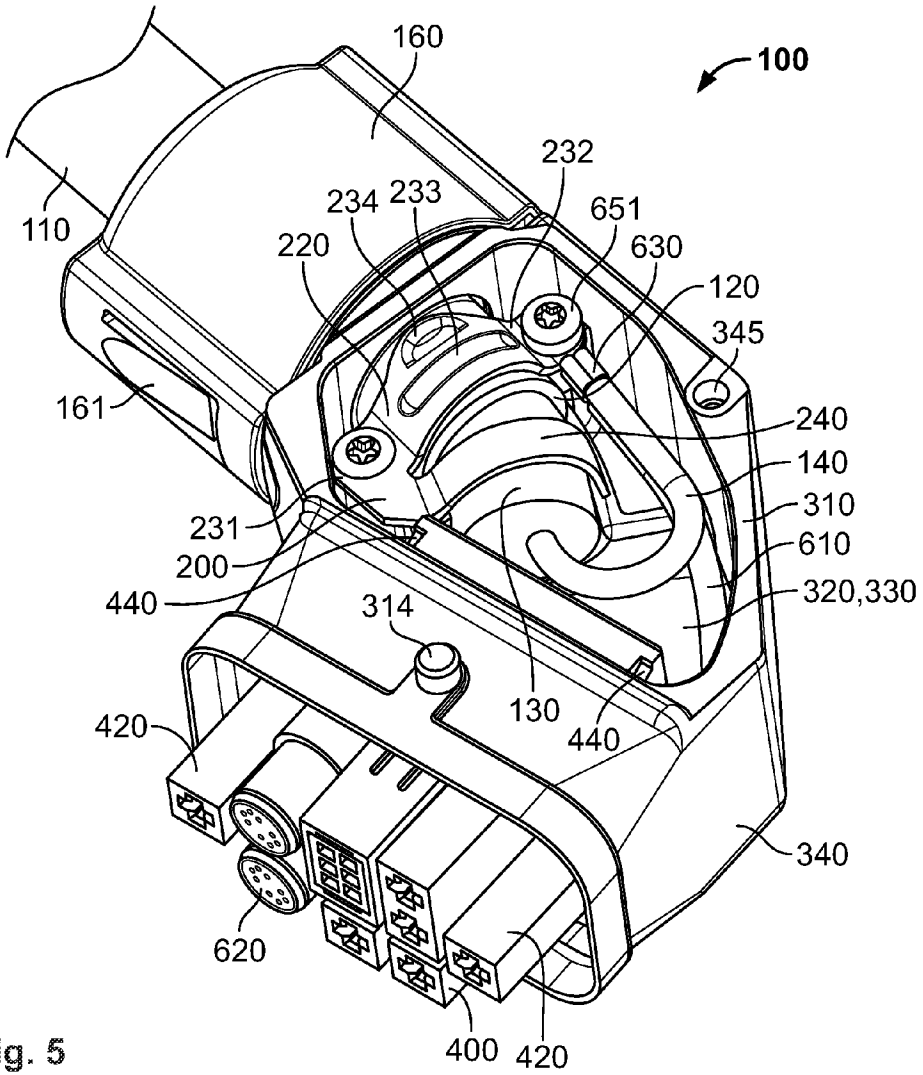
Figure 5:
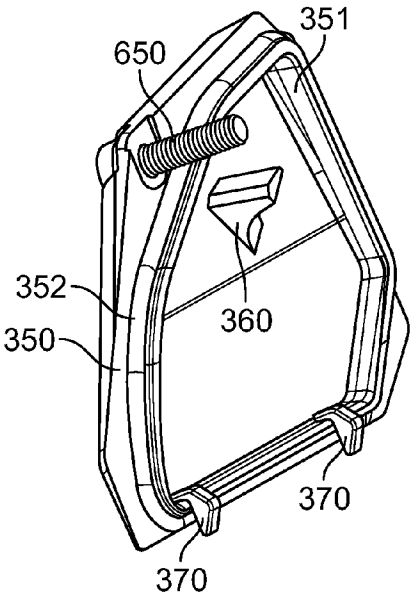
Figure 6:
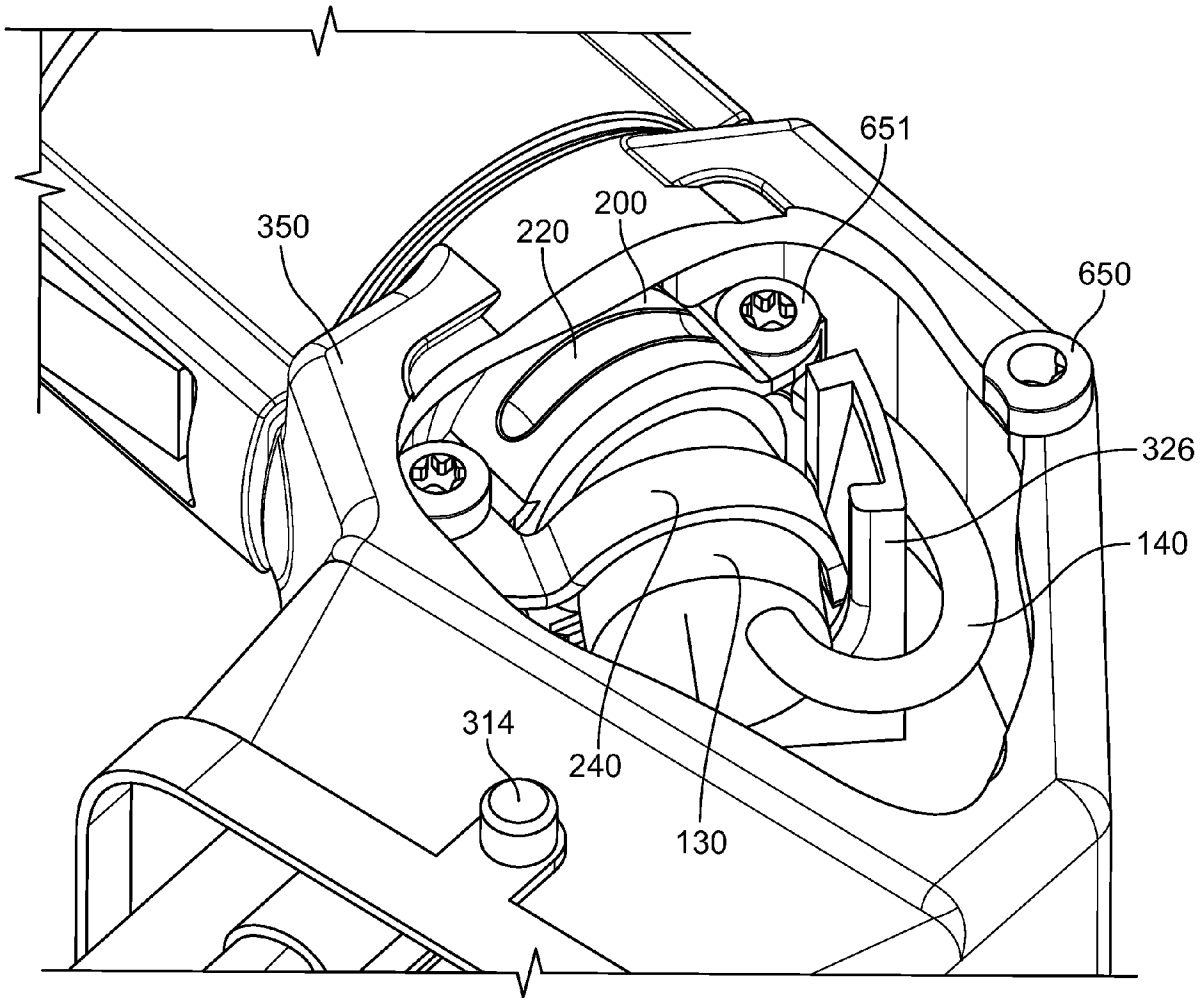
Figure 7:
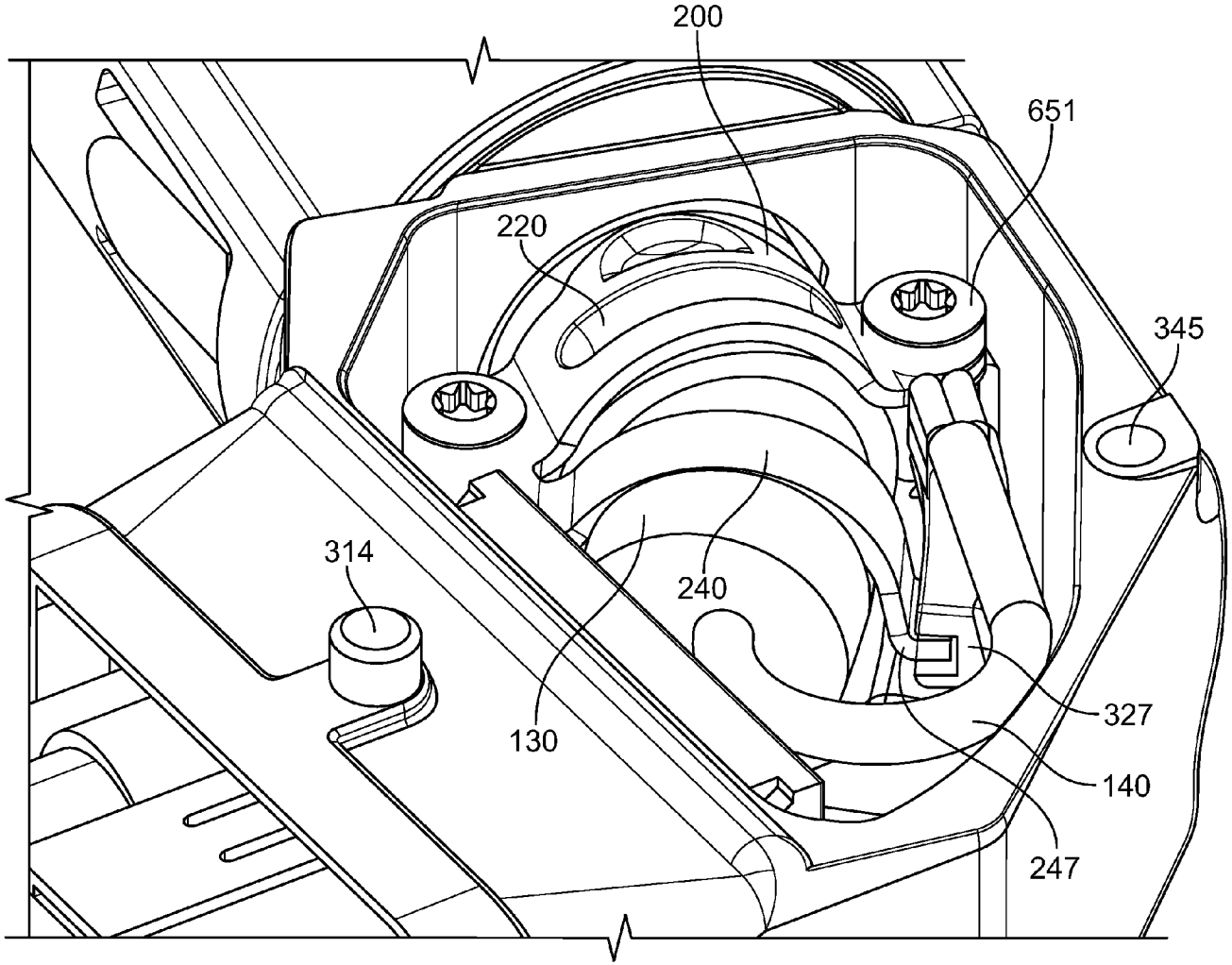
Figure 8:
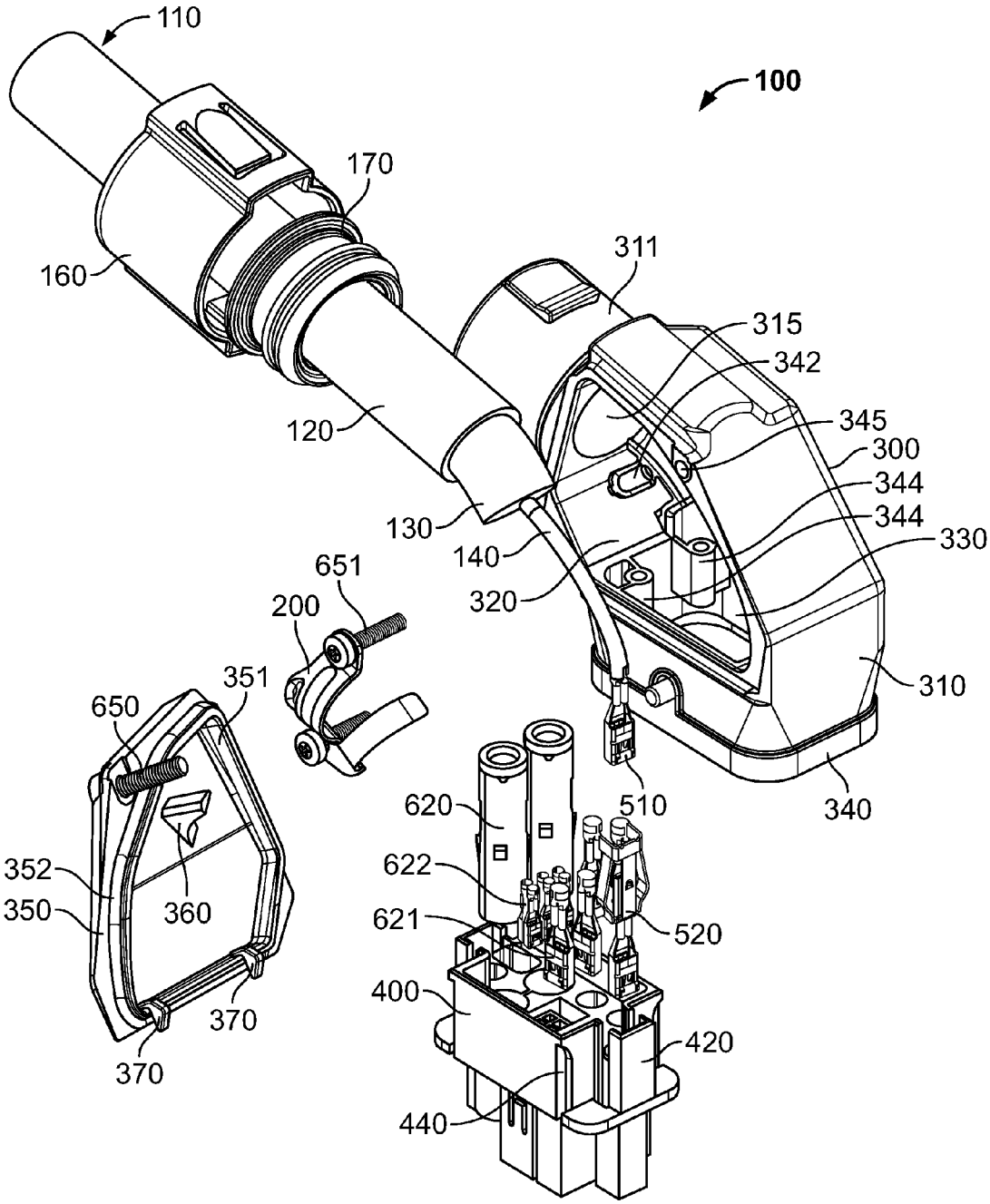
Figure 9:
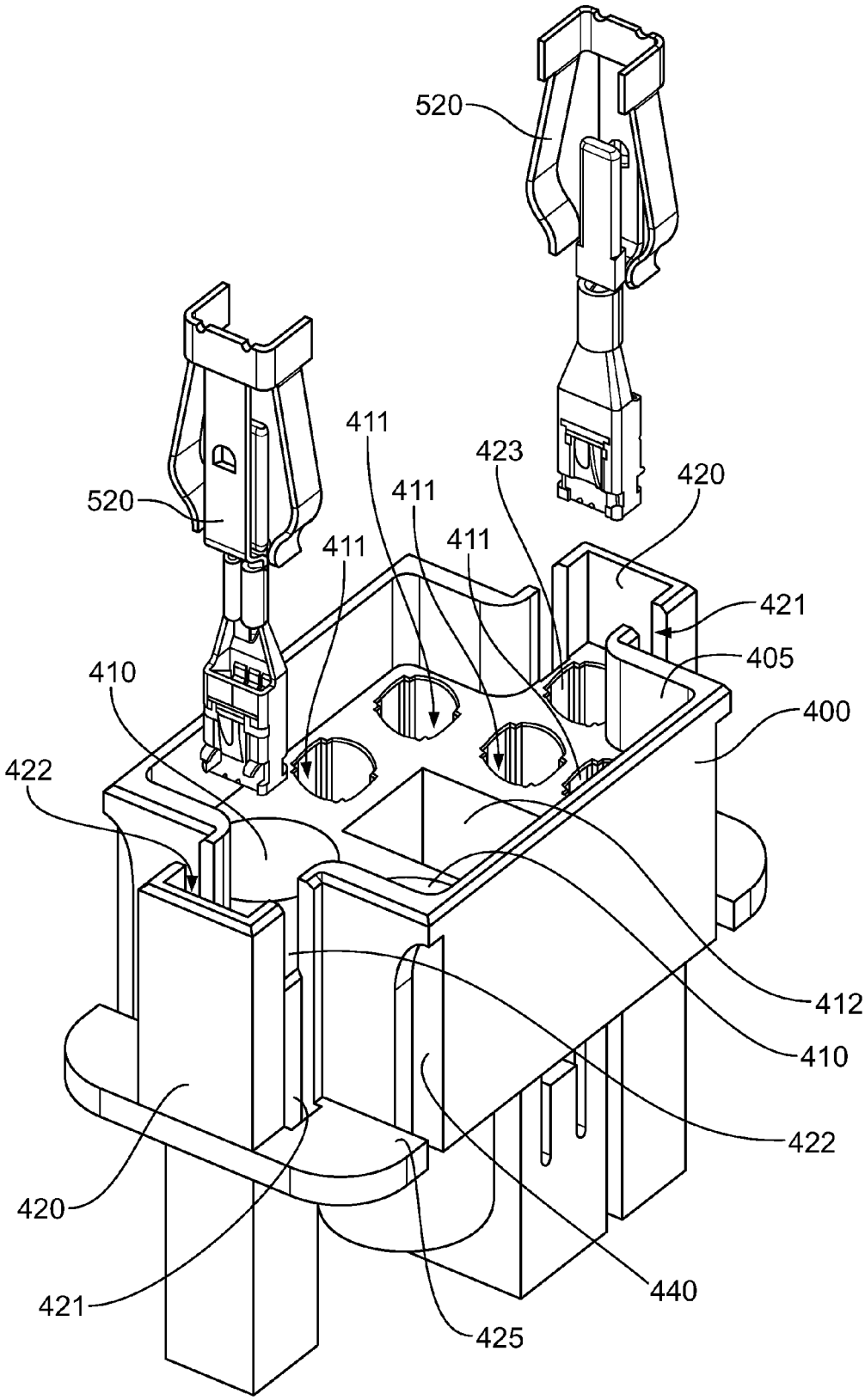
Figure 10:
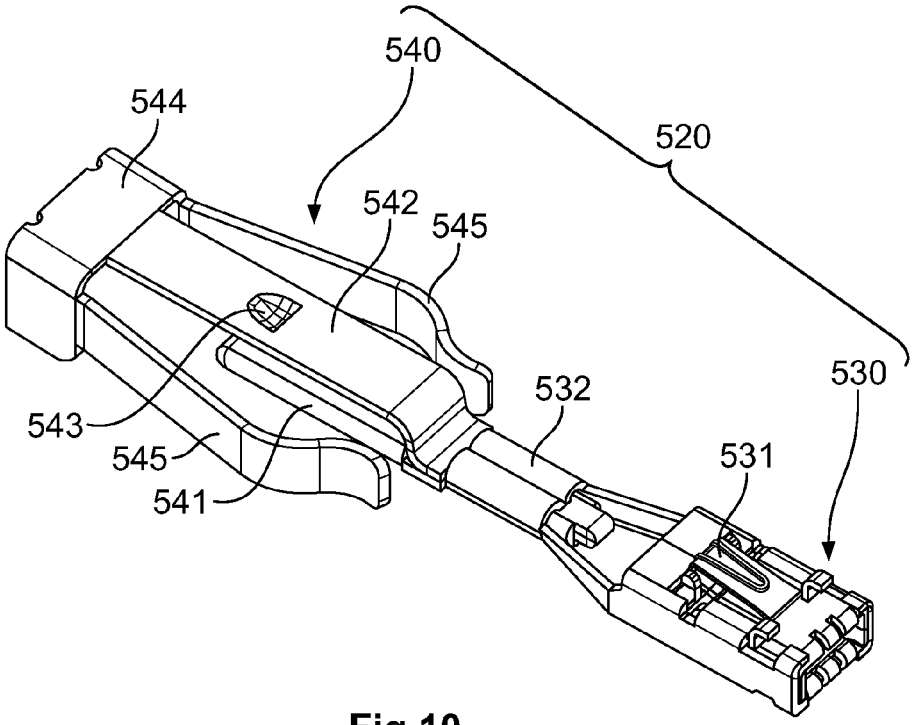
Figure 11:
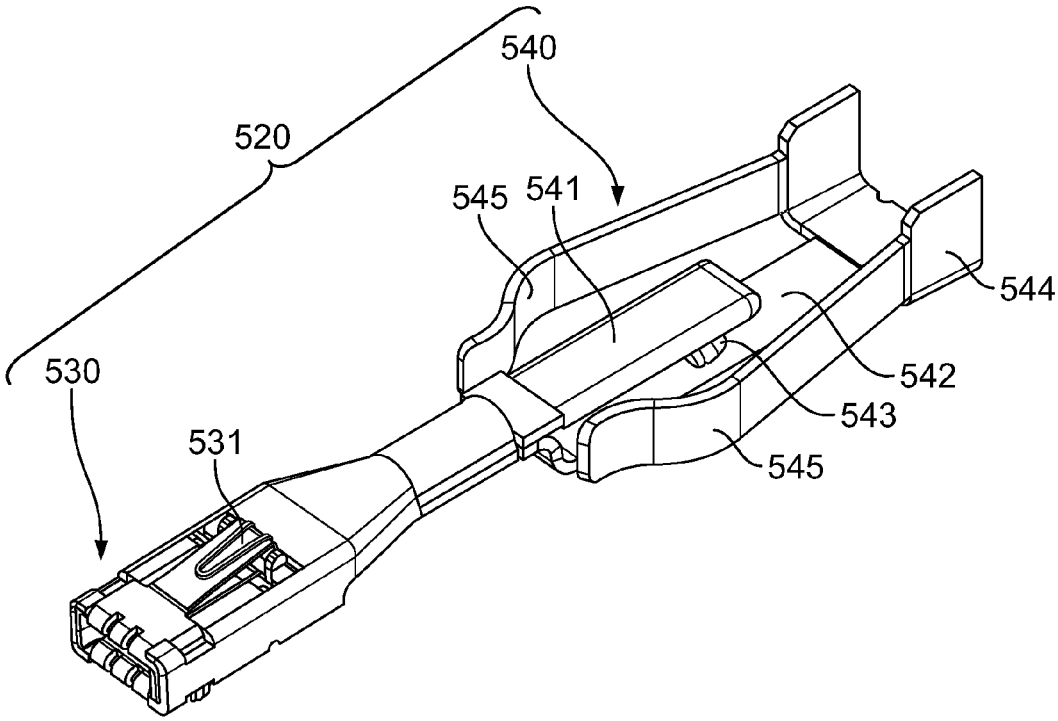
Figure 13:
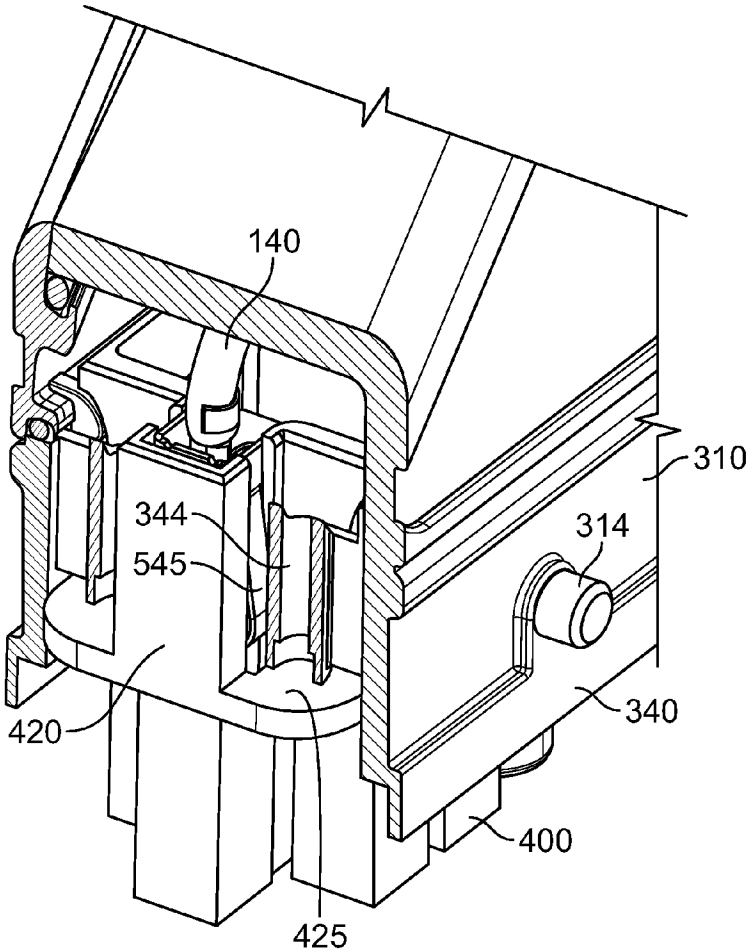
Figure 12:
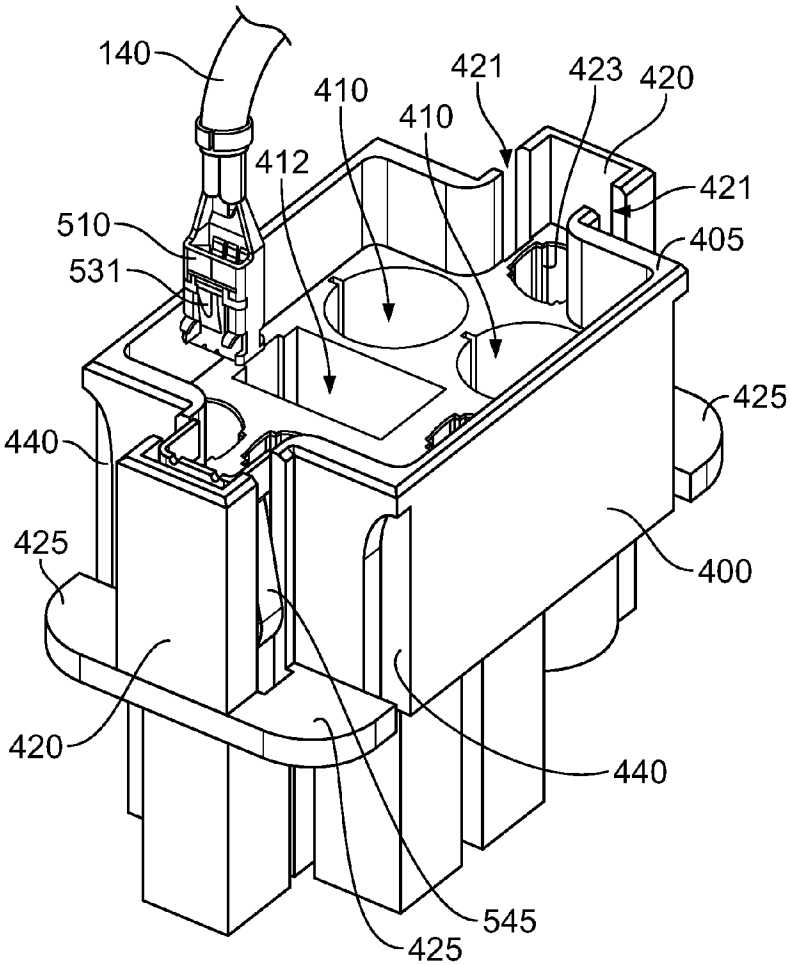
Figure 15:
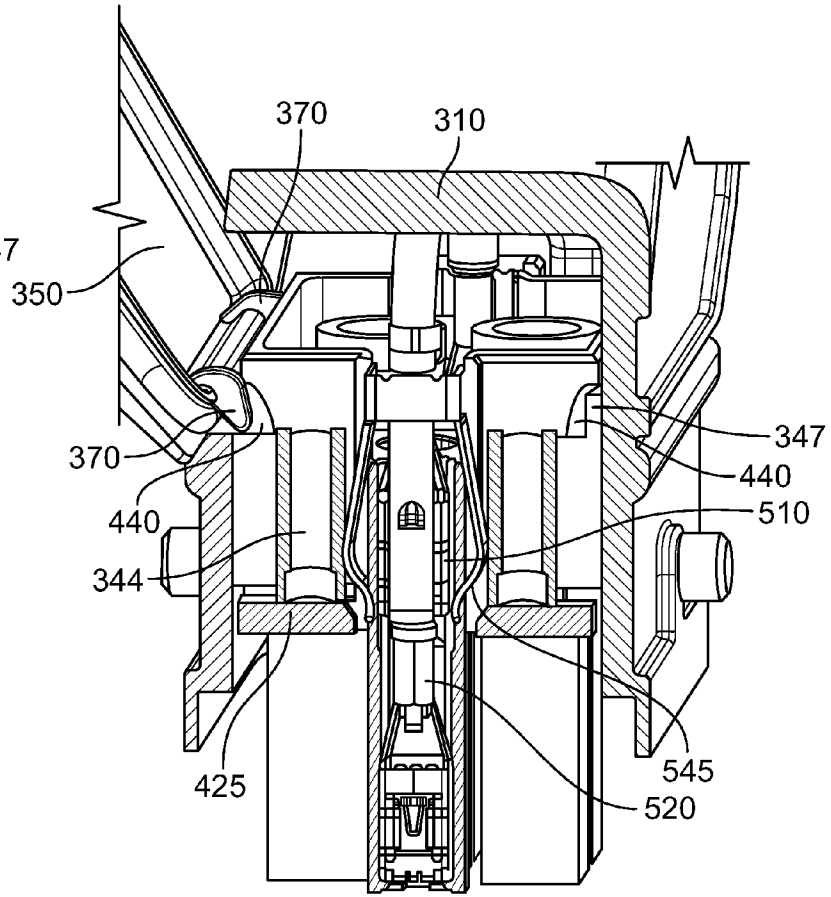
Figure 14:
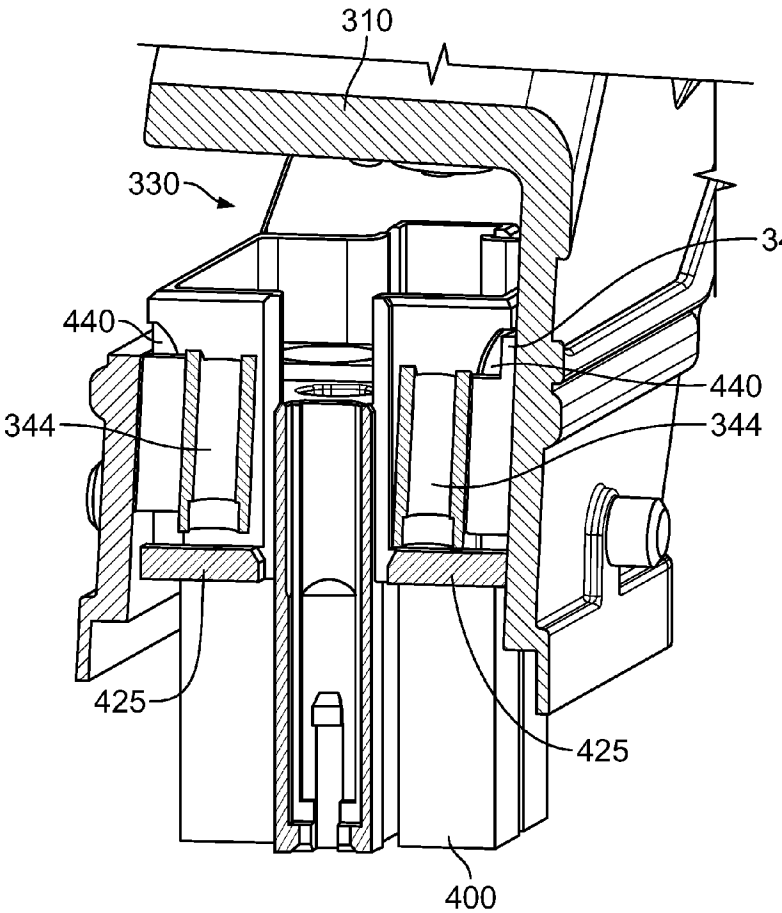
Figure 16:
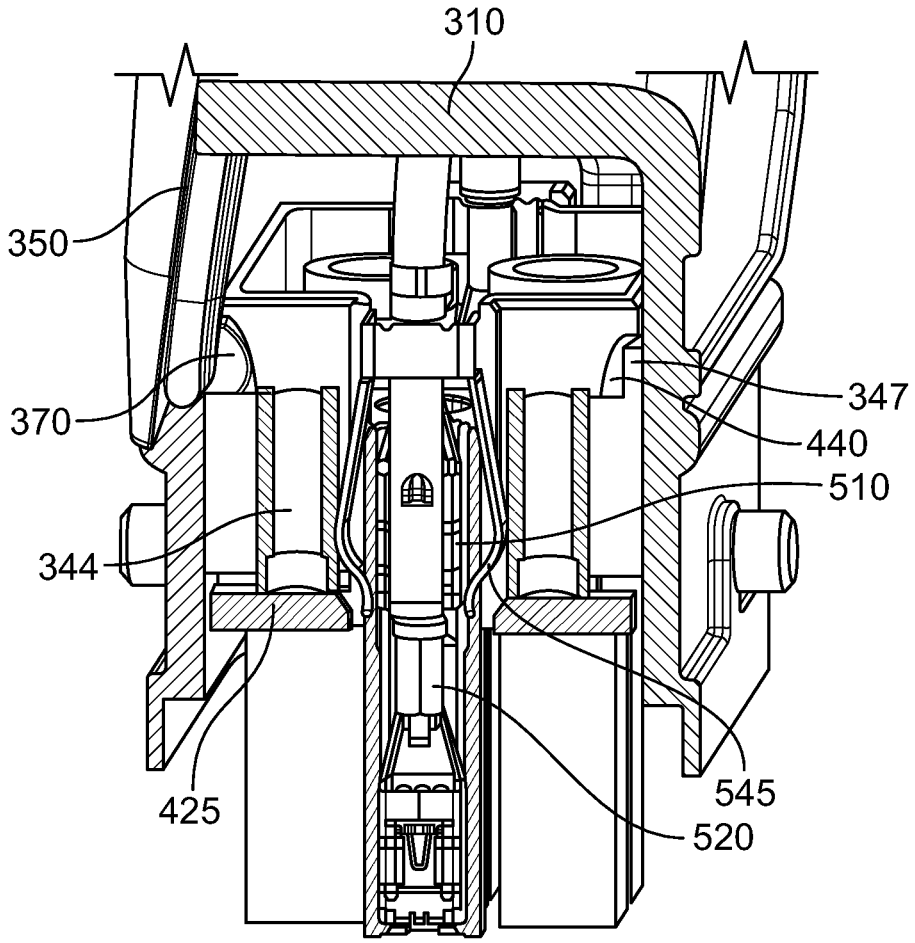
Figure 17:
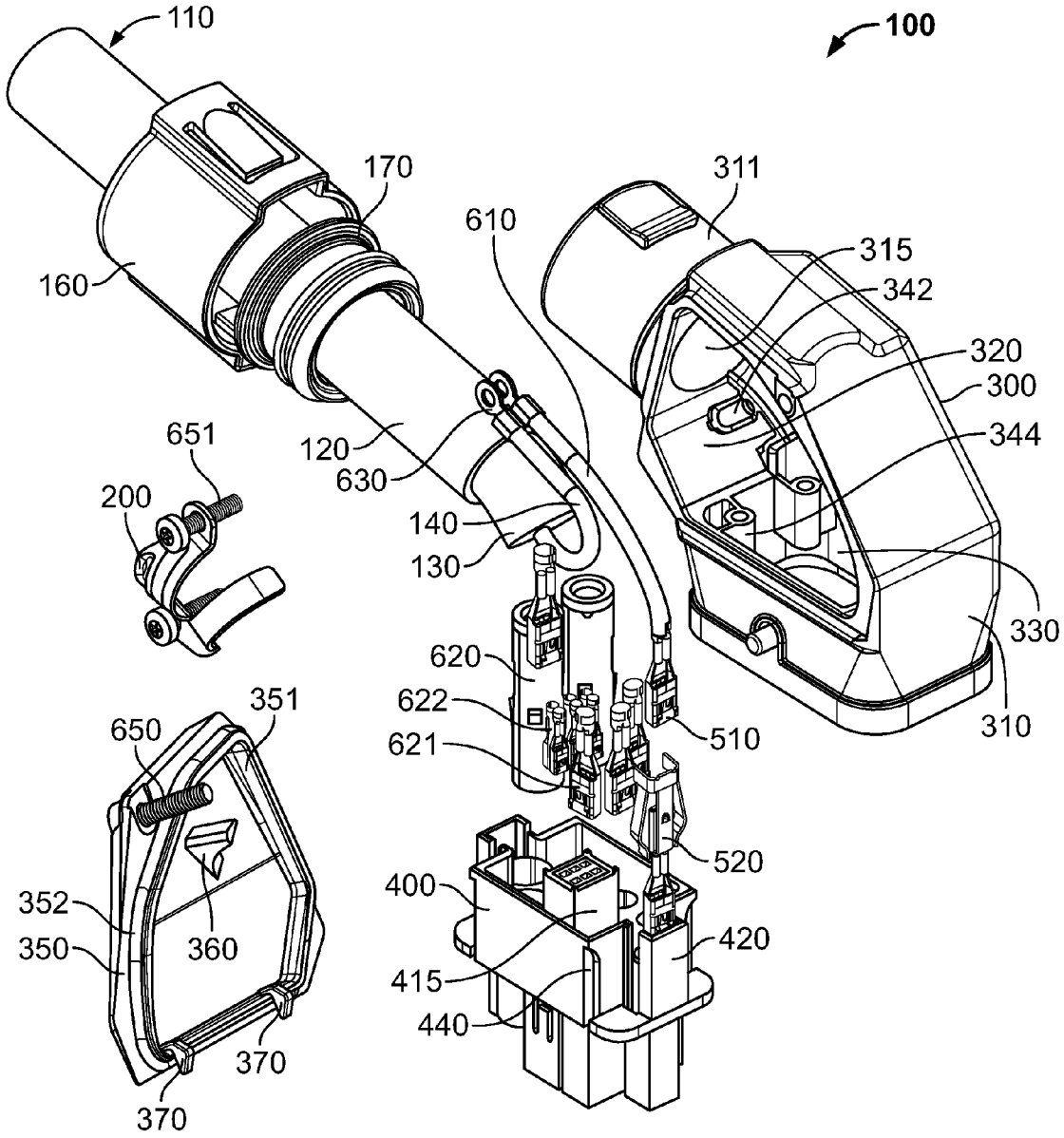
Figure 18:
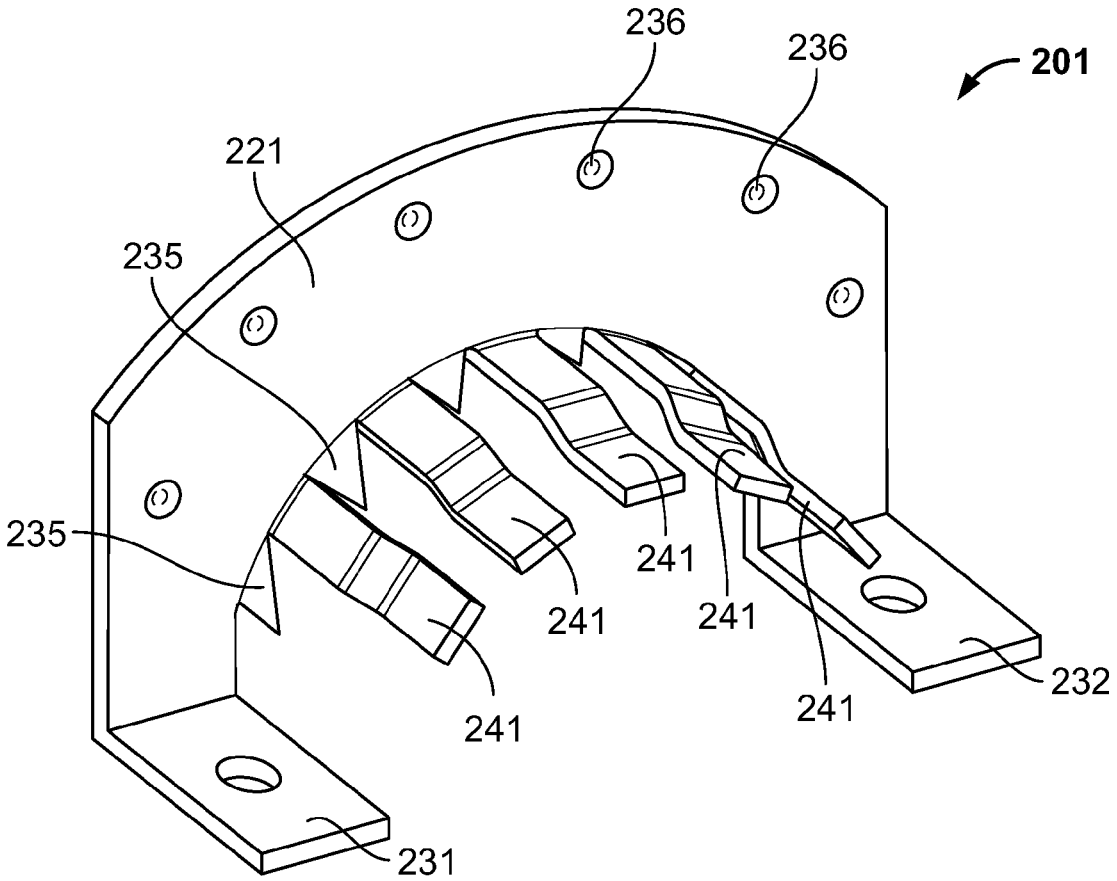
Figure 19:
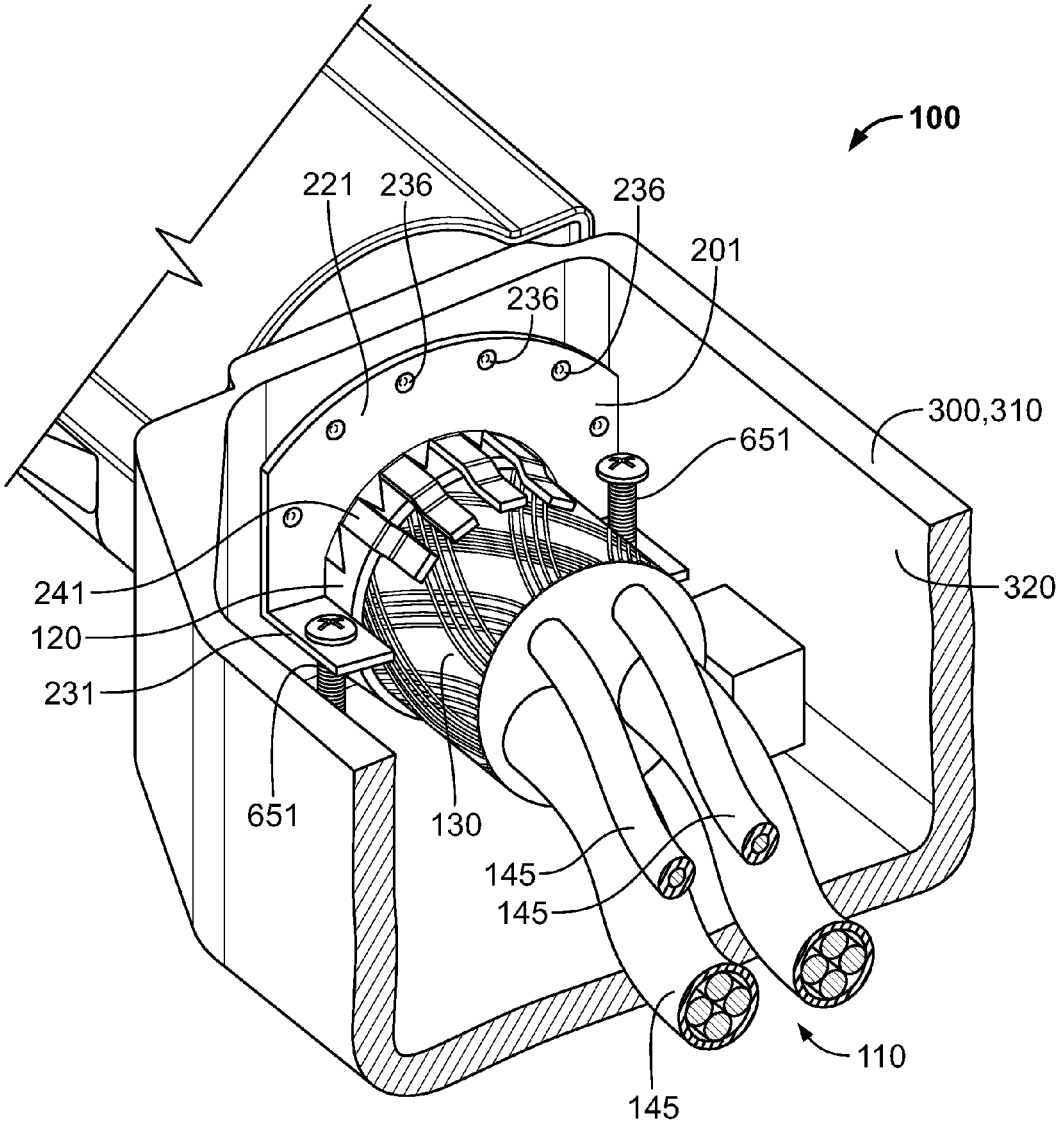
Figure 20:
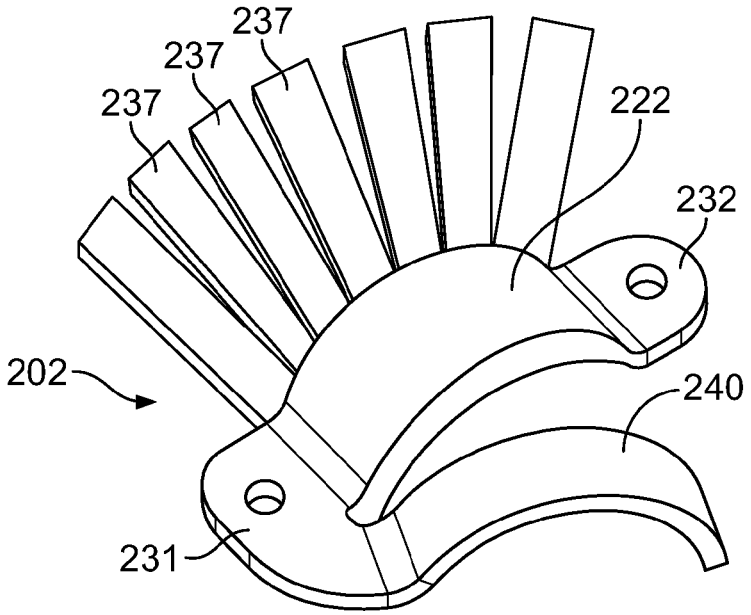
Figure 21:
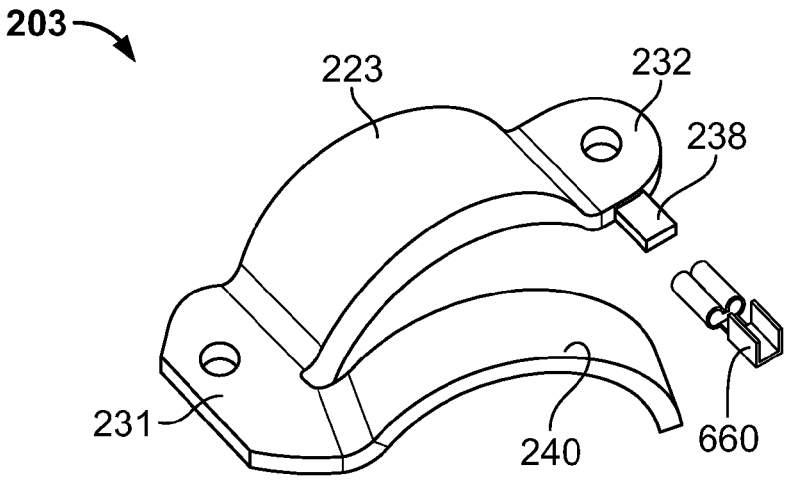

The invention will be explained in greater detail below with reference to the figures. These show:

FIG. 1: a perspective exploded view of components of a contact means and an end section of a cable;

FIG. 2: a top view of the partially assembled contact means with the cable to illustrate details of a pull relief element;

FIGS. 3 and 4: perspective views of the partially sectional contact means of FIG. 2 to illustrate different possible ways of contacting for a protective conductor of the cable and an additional line of the contact means;

FIG. 5: a further perspective view of components of the contact means;

FIGS. 6 and 7: enlarged section views of the contact means to illustrate different structures with the aid of which a contacting section of the pull relief element can be pressed against a shield of the cable;

FIG. 8: a perspective exploded view of a further contact means and a cable;

FIG. 9: a perspective view of a contact insert with contact elements;

FIGS. 10 and 11: enlarged perspective views of a contact element of FIG. 9;

FIG. 12: a further perspective view of the contact insert with a contact element arranged in the contact insert and a further contact element fastened to a line;

FIG. 13: a further perspective view of the contact insert, which is arranged on a casing of a contact means;

FIGS. 14 to 16: section views illustrating the fastening of a contact insert to a casing;

FIG. 17: a perspective exploded view of a further contact means and a cable;

FIG. 18: a perspective view of a further pull relief element;

FIG. 19: a perspective partially sectional view of a contact means with the pull relief element of FIG. 18;

FIGS. 20 and 21: perspective views of further pull relief elements; and

Figure 23:
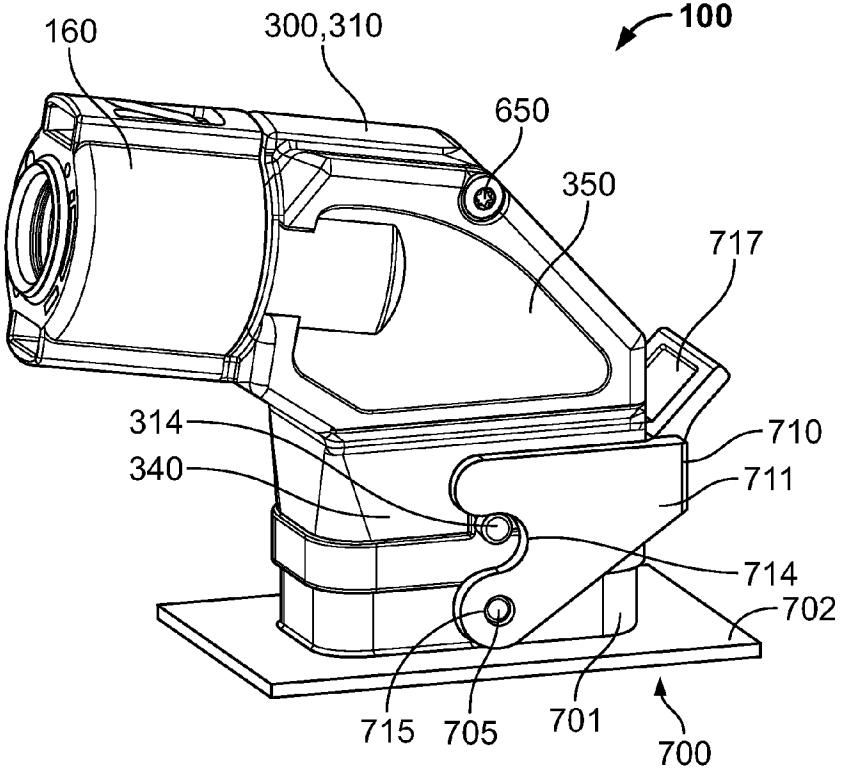
Figure 22:
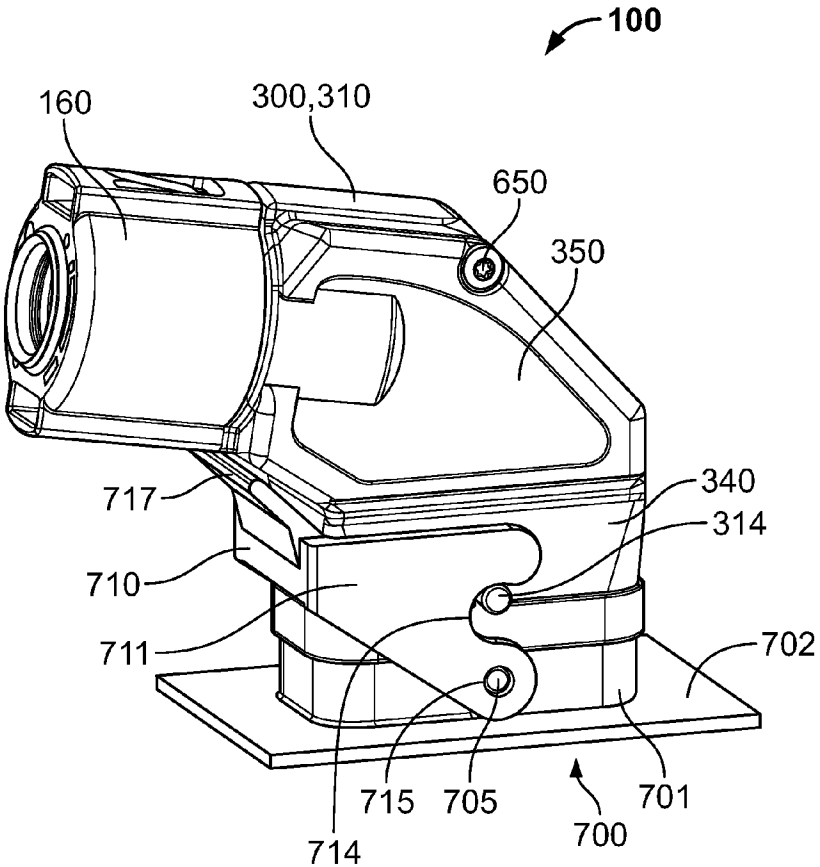

FIGS. 22 and 23: perspective views of a contact means which is fastened to a complementary contact means with a locking stirrup.

Possible configurations of contact means 100 which can be used for attaching an end of a cable 110 will be explained with reference to the following figures. The contact means 100 illustrated, which are also referred to as plugs or connectors, serve as an interface for connecting the cable 110 to a complementary connector mating part 700 of another device. One advantage of the contact means 100 illustrated is that the contact means 100 can be attached to the cable 110 in a simple and time-saving manner.

One possible field of use for the cable 110 is the decentralised control of electric motors in the industrial field. In this case, the cable 110 can be used both for transmitting control signals of a motor and for supplying power or voltage thereto. The cable 110 can be connected for example to a complementary contact means 700 of a printed circuit board (PCB), via a contact means 100, which with respect to such a combined application can also be referred to as a "hybrid interface".

FIG. 1 shows a perspective exploded view of a contact means 100 and of a section of a cable 110 in the region of a cable end. The cable 110 is a multi-core cable which has a plurality of lines, not shown in FIG. 1, for supplying power and transmitting signals, and also a protective conductor 140, also referred to as a PE conductor ("protective earth"). The lines of the cable 110 are surrounded by an electrically conductive shield 130 which is formed for example in the form of a wire, foil or strand braid. The cable 110 further has a cable sheath 120 made from an insulating material, for example a plastics material, which surrounds the shield 130 for example in circular fashion.

The shield 130 serves to guarantee the electromagnetic compatibility (EMC) of the cable 110. In this case, the shield 130 is intended to ensure that on one hand electromagnetic fields acting externally on the cable 110 and on the other hand electromagnetic fields radiating from the cable 110 are shielded, in order to avoid interference associated therewith.

The components of the contact means 100 illustrated in FIG. 1 include a casing 300 consisting of an electrically conductive or metallic material which comprises a substantially curved or angled casing base part 310 and a casing cover 350. The casing base part 310 and the casing cover 350 can for example be produced in die-casting operations. The casing base part 310 surrounds an inner chamber 320, in which a section of the cable 110 can be received in the region of the cable end. The inner chamber 320, in the unassembled state according to FIG. 1, is exposed via a lateral casing opening 330 which extends along one side of the casing base part 310 between a sealing region 311 and a contact-insert region 340, and which can be closed by the casing cover 350. Such a configuration of the casing base part 310 with the lateral casing opening 330 permits time-saving attachment, which can be visually monitored, of the contact means 100 to the cable 110. Furthermore, the casing base part 310 has a form which is widened in the cable exit direction (i.e. in the direction of the contact-insert region 340). This facilitates the assembly in the event that the cable 110 is relatively resistant to bending.

The sealing region 311 of the casing base part 310 provided for rear-side or entry-side sealing is substantially hollow-cylindrical, and forms, adjoining the inner chamber 320, an access opening 315 via which the cable 110 can be inserted into the inner chamber 320 on the entry side. The sealing region 311 is formed to receive both the cable 110 and an annular cable seal 170 which surrounds the cable 110 on the periphery. The cable seal 170 has an elastic material such as for example a rubber or a silicone material. Further, a covering cap 160 made of for example a plastics material is provided for fixing the cable seal 170 arranged in the sealing region 311, which cap can be pushed on to the sealing region 311.

The contact-insert region 340 provided on the casing base part 310 on the exit side is substantially rectangular and has a further opening via which the cable 110 is guided out of the casing base part 310 upon assembling the contact means 100, and on or inside which further a contact insert 400 of the contact means 100 can be arranged. On the outsides, the contact-insert region 340, as illustrated in FIGS. 5 to 7, may further have cylindrical raised sections or latch stirrups 314, with the aid of which the contact means 100 can be latched on a complementary contact means 700. This will be discussed in greater detail further below in conjunction with FIGS. 22 and 23.

The contact insert 400 has an insulating material, such as for example a plastics material, and serves to receive and hold contact elements 620, 621, 622 which can be connected to the individual lines of the cable 110 and an additional line 610 of the contact means 100. The contact elements 620, 621, 622 may be arranged in corresponding recesses or receptacles of the contact insert 400, and may also be latched in the contact insert 400 with the aid of corresponding latch elements (for example raised sections and depressions).

Contact elements which are considered, as illustrated in FIG. 1, are for example two Ethernet female contacts 620, five flat female contacts 621 and six flat female contacts 622. The Ethernet female contacts 620 may be connected to corresponding Ethernet lines of the cable 110 which are provided for transmitting signals, one Ethernet line possibly comprising four individual lines. The female contacts 621, 622 of different sizes represent, for example "MCON" female contacts ("multi-contact") of different sizes (for example with a contact width or a contact diameter of 1.2 mm and 2.8 mm) which can be connected to individual lines by crimping, and into which complementarily formed male flat-contact contact elements can be inserted.

With regard to the cable 110, provision may be made for connecting the six small female contacts 622 to associated control lines of the cable 110, and for connecting four of the larger female contacts 621 to lines of the cable 110 for supplying power. One of the female contacts 621 is further, as illustrated in FIG. 1, connected to one end of the additional line 610. With regard to the small contact elements 622, there is further the possibility of arranging them in their own contact casing 415, which is inserted into the contact insert 400 (cf. FIG. 17).

As a further component, the contact means 100 comprises a clip-shaped pull relief element 200 made from an electrically conductive or metallic material, which, as illustrated in FIG. 1, can be fastened in the inner chamber 320 of the casing base part 310 in a simple and time-saving manner for example with the aid of screws 651. The screws 651 can be screwed on the casing base part 310 into associated casing bores 342 which are provided with an internal thread. The pull relief element 200 is used on one hand to fix the cable sheath 120 of the cable 110 for providing pull relief, and on the other hand to contact the shield 130 of the cable 110.

An electrical connection between the shield 130 and the casing 300 can be produced by means of the "shield tap" of the pull relief element 200, which allows effective EMC shielding of the inner chamber 320 to be realised. At the same time, the protective conductor 140 can also be attached to the shield 130 of the cable 110 via the pull relief element 200, by means of which, depending on the application, for example protective switching-off carried out with the aid of the protective conductor 140 can be improved. Further details of the contact means 100 and the components thereof will be described below with reference to an assembly (by way of example) of the contact means 100 on the cable end of the cable 110.

In the assembly method, the covering cap 160 and the cable seal 170 are pushed on to the cable 110 in the region of the cable end, corresponding to the illustration of FIG. 1. The cable 110 is further introduced through the sealing region 311 and the access opening 315 into the inner chamber 320 of the casing base part 310, and is guided out of the casing base part 310 again through the contact-insert region 340 or the opening provided at this point, so that an end section of the cable 110 projects out of the casing base part 310.

The passing of the cable 110 through the casing base part 310 is facilitated by the configuration with the casing opening 330, since deflection of the cable 110 supported (manually) from outside is made possible. This is in particular advantageous if the cable 110 is relatively resistant to bending. The passing-through of the cable 110 is further simplified in that the casing base part 310, as described above, has a form which is widened in the cable exit direction, by means of which the cable 110 can be bent in as large a radius as possible.

Following this, a part of the cable sheath 120 and a part of the shield 130 is removed at the cable end (projecting out of the casing base part 310), by means of which the lines of the cable 110 including the protective conductor 140 are exposed and separated. The cable sheath 120, corresponding to the illustration in FIG. 1, is removed to a greater extent than the shield 130, so that the shield 130 has an exposed region which is no longer encompassed by the cable sheath 120. Also, the ends of the lines of the cable 110 are stripped, and connected to the associated contact elements 620, 621, 622.

The protective conductor 140 (likewise stripped at the end) is further, as indicated in FIG. 1, connected to a cable terminal 630, for example by crimping, which terminal has at one end crimping tabs and at an opposite end an annular contact, i.e. an annular contact section. Such an annular-contact cable terminal 630 is also fastened to a (stripped) end of the additional line 610. Further, one of the contact elements 621 is connected to an opposed (stripped) end of the additional line 610. The additional line 610 may alternatively also already be provided with the attached cable terminal 630 and the attached contact element 621.

Subsequently, the contact elements 620, 621, 622 which are connected to the respective lines are arranged in the contact insert 400 or in associated receptacles of the contact insert 400. With regard to the contact element 621 which is connected to the additional line 610, the contact insert 400 may have two lateral receiving regions 420, the relevant contact element 621 being inserted into one of the receiving regions 420. It is also possible to provide the contact insert 400 "pre-fitted", i.e. for the additional line 610 with the contact element 621 to be already arranged on the contact insert 400. Further (possible) details on the contact insert 400 and the construction thereof will be described in greater detail further below.

The contact insert 420 with the inserted contact elements 620, 621, 622 is then, together with the end section of the cable 110 and the additional line 610, inserted via the contact-insert region 340 into the casing base part 310. In so doing, the contact insert 400 is arranged within the contact-insert region 340, with corresponding fastening and stop structures of the contact insert 400 and of the contact-insert region 340 which are matched to one another, which will be discussed in greater detail further below, defining an end position of the contact insert 400. In this position, part of the contact insert 400 projects out beyond a lower edge of the casing base part 310 or of the contact-insert region 340 (cf. FIG. 2).

Subsequently, the cable seal 170 which surrounds the cable 110 on the periphery is inserted into the hollow-cylindrical sealing region 311 of the casing base part 310, and the covering cap 160 is pushed on to the sealing region 311 (cf. FIGS. 2 and 5). In this case, the cable seal 170 lies against a corresponding casing wall within the sealing region 311, and is further secured against moving away from this position via the covering cap 160. The covering cap 160 has latch tabs 161 provided on opposing sides (cf. FIGS. 1 and 5), which tabs cooperate with corresponding raised sections 312 of the sealing section 311 or latch thereon, by means of which the covering cap 160 is fixed on the sealing region 311 of the casing base part 310. In this manner, the inner chamber 320 of the casing base part 310 is sealed off at this point from external influences such as for example splashes and dirt.

Following this, the attachment of the pull relief element 200 in the inner chamber 320 of the casing base part 310 takes place with the aid of the screws 651, this being made possible by the configuration of the casing base part 310 with the casing opening 330, which serves as a "window" or "assembly window". In this case, the annular-contact cable terminals 630 connected to the protective conductor 140 and the additional line 610 are also fastened to the casing base part 310, which produces the arrangement shown in the top view of FIG. 2 and the perspective view of FIG. 5.

FIGS. 2 and 5 make the construction of the pull relief element 200 apparent. The pull relief element 200 has a substantially curved clip-shaped section 220, with the aid of which a stable pull relief can be realised, and which will therefore be referred to below as a pull relief section 220. At the ends, the pull relief section 220 has in each case a for example planar fastening region 231, 232 with a hole through which to pass a screw 651 (cf. also the embodiments of FIGS. 20 and 21). The screws 651 may be screwed into associated casing bores 342 of the casing base part 310, by means of which the pull relief element 200 can be fastened to the casing base part 310. One of the fastening regions 231 further merges into a further substantially curved and clip-shaped section 240, with the aid of which the exposed shield 130 of the cable 110 can be contacted. The section 240 will therefore be referred to below as contacting section 240. Owing to the different functions of the sections 220, 240 of the pull relief element 200, the pull relief element 200 can also be referred to as a "combi clip". Instead of the fastening with the aid of screws 651 which is described, alternatively also other possibilities of fastening are conceivable, as will be described in greater detail further below.

The pull relief element 200 can be manufactured inexpensively in one piece, for example from a metal sheet. The two sections 220, 240 of the pull relief element 200 which are connected together, as becomes clear with reference to FIG. 2, are offset in their orientation by a certain angle, so that the pull relief element 200, viewed from above, has substantially a V-shaped form. The V-shape is selected corresponding to the curved course of the cable 110 (including the lines, not shown) in the inner chamber 320 of the casing base part 310.

The pull relief section 220 of the pull relief element 200 is formed to fix the cable sheath 120 of the cable 110 in the arrangement illustrated in FIGS. 2 and 5. In this case, the cable 110 is located between the casing bores 342 provided for fastening the pull relief section 220 (of which a casing bore 342 is indicated in FIG. 1), so that the cable 110 is partially encompassed by the screwed-on pull relief section 220 and as a result of this the cable sheath 120 is clamped or squeezed for stable holding. In order to improve the pull relief, the pull relief section 220 further has an elongate indentation or embossed section 233 in the direction of the cable sheath 120 between the fastening regions 231, 232, which recess or embossed section permits intensified clamping of the cable sheath 120. Furthermore, a laterally outwards-projecting round region with a cut hole 234 is provided on the pull relief section 220, which means that the pull relief section 220 further has a cutting-in edge which cuts into the cable sheath 120 for additional fixing.

In the position of the pull relief element 200 which is screwed on to the casing base part 310, the convex contacting section 240 thereof lies in surface-to-surface contact against the exposed region of the shield 130 of the cable 110. This makes possible two-dimensional and hence reliable and effective contacting of the shield 130 by the pull relief element 200. Since the pull relief element 200 is fastened to the casing base part 310, an electrical connection is also produced between the shield 130 of the cable 110 and the casing 300 or casing base part 310, by means of which the inner chamber 320 can be reliably shielded.

Furthermore, as described above, provision is made also to connect the protective conductor 140 to the shield 130 of the cable 110. To this end, the annular contact sections of the two cable terminals 630 which are connected to the protective conductor 140 and the additional line 610, as illustrated in FIG. 3, are arranged between the fastening region 232 of the pull relief element 200 and the region of the casing base part 310 with the bore 342 such that both the pull relief element 200 and the cable terminals 630 are fixed at this point by screwing in the associated screw 651. This means that the protective conductor 140 is electrically connected to the casing 300 or casing base part 310 and via the pull relief element 200 to the shield 130 of the cable 130. The additional line 610 (likewise) connected at this point serves to permit contacting of the protective conductor 140 to the outside or from outside the contact means 100.

FIG. 4 shows a possible way of contacting which is modified somewhat compared with FIG. 3 (and FIG. 1) in which merely a single annular-contact cable terminal 630 is provided between the fastening region 232 of the pull relief element 200 and the casing bore 342. The cable terminal 630 is connected by means of crimping both to the protective line 140 and to the additional line 610 ("double stop"). The crimping can take place for example before the pushing-back of the cable 110 which is described above and the insertion of the contact insert 400 to the end position thereof on/in the contact-insert region 340 of the casing base part 310.

In order to complete the assembly of the contact means 100 on the cable 110, once the pull relief element 200 has been attached in the inner chamber 320 the casing cover 350 is fastened to the casing base part 310, by means of which the inner chamber 320 of the casing base part 310 is closed and hence sealed off and shielded.

The casing cover 350, as illustrated in FIGS. 1 and 5, has a substantially two-dimensional form, and on the inside a ridge-shaped circumambient raised section 351. The course of the raised section 351 corresponds to the contour of the casing opening 330 of the casing base part 310, so that in the closed state a planar edge region, surrounding the raised section 351, of the casing cover 350 lies against a planar region, surrounding the casing opening 330, of the casing base part 310, which means that the casing cover 350 contacts the casing base part, and the raised section 351 projects into the inner chamber 320 on the edge of the casing opening 330. For effective sealing of the inner chamber 320, a circumambient sealing element 352 is provided on the outside or on the periphery on the raised section 351, which element has an elastic material such as for example a rubber material or a silicone material. The sealing element 352 may for example be an O-ring deformed corresponding to the raised section 351. The elastic material of the sealing element 352 may further have electrically conductive or metallic particles added to it in order to improve the EMC shielding of the inner chamber 320.

For fastening the casing cover 350 to the casing base part 310, the casing cover 350 has two claw-shaped holding elements 370, which, when the casing cover 350 is attached to an edge of the casing base part 310, can be hung in the region of the casing opening 330, and by means of which the hung casing cover 350 can be pivoted in the direction of the casing base part 310. For final fixing of the casing cover 350, a further screw 650 is provided which can be passed through a corresponding hole on the edge of the casing cover 350 and can be screwed into a further bore 345, provided with an internal thread, of the casing base part 310 next to the casing opening 330. With regard to the attachment of the casing cover 350, provision is further made for the claw-shaped holding elements 370 to engage in correspondingly formed cut-outs 440 in the contact insert 400 which is arranged in the end position (cf. FIG. 5), which means that the contact insert 400 can be fastened in a simple and time-saving manner to the casing base part 310. This and also further (possible) details of the contact insert 400 will be discussed in greater detail further below.

In addition to closing the inner chamber 320 and fastening the contact insert 400 to the casing base part 310, the casing cover 350 can further be used to improve contacting of the shield 130 of the cable 110 by the contacting section 240 of the pull relief element 200. The casing cover 350 to this end, as illustrated in FIGS. 1 and 5, may have a pressure-application structure 360 with a convex side arranged on the inner side of the casing cover 350, which convex side is adapted to the convex form of the contacting section 240 (or of the region of the shield 130 which is to be contacted). This configuration means that the pressure-application structure 360 of the casing cover 350, upon the closing of the inner chamber 320 or in the closed state, additionally presses the contacting section 240 against the shield 130. In particular central and/or lateral application of pressure to the contacting section 240 is considered. The application of pressure provides the possibility of achieving reliable contacting of the shield 130 even with different cables 110 with various cable diameters.

In order further to promote reliable contacting of the shield 130 of the cable 110, further, structural elements which cooperate with the contacting section 240 of the pull relief element 200 may be provided on the casing base part 310 in the region of the inner chamber 320. One possible example is shown in FIG. 6. In this case, an additional structural element 326 which has a groove for guiding the contacting section 240 and within the groove an obliquely extending side wall is provided in the inner chamber 320. The oblique side wall makes it possible, when pressure is applied on the contacting section 240 by the pressure-application structure 360 of the casing cover 350, to press the contacting section 240 or an end region thereof additionally against the shield 130.

A further possible configuration is illustrated in FIG. 7. In this case, the casing base part 310 has a structural element 327 with an overhanging edge within the inner chamber 320. Such a configuration can for example, as indicated in FIG. 7, be realised by a horizontally extending slot-shaped cut-out. Correspondingly, the contacting section 240 of the pull relief element 200 is provided with a planar end section 247 extending horizontally from the curved region of the contacting section 240, which end section can be hooked beneath the overhanging edge of the structural element 327 in order to achieve additional pressing of the contacting section 240 against the shield 130 of the cable 110. To attach the pull relief element 200 of FIG. 7 in the inner chamber 320, first the horizontal section 247 is arranged or hooked under the overhanging edge section (or in the slot-shaped cut-out) of the structural element 327, then the pull relief element 200 is pivoted into the corresponding assembly position and then, as described above, fixed with the screws 651 to the casing base part 310. In this configuration, it is possible also to form the casing cover 350 without a pressure-application structure 360.

FIG. 8 shows a perspective exploded view of a further contact means 100, which has substantially the same components and the same construction as the embodiment(s) explained with reference to FIGS. 1 to 7 above. With regard to details already described which relate to similar or matching components, method steps for assembly which can be used, possible advantages etc., reference is therefore made to the above statements.

One difference in the contact means 100 of FIG. 8 is that no additional line 610 is provided. The protective conductor 140 (or the end thereof) is therefore itself arranged on the contact insert 400 via a corresponding contact element 510. The contact element 510 comprises or represents a flat female contact, for example one of the (MCON) female contacts 621 described above. In order, in this configuration too, to produce an electrical connection between the protective conductor 140 and the shield 130 of the cable 110, in addition to the contact element 510 connected to the protective conductor 140 a further contact element 520 is provided which is arranged in the contact insert 400 and which can be contacted by the contact element 510 of the protective conductor 140. The contact element 520 is formed to produce an electrical connection with the casing 300, the casing 300 (in the manner described above) further being able to be connected electrically via the pull relief element 200 to the shield 130 of the cable 110. Further details of this possible way of contacting—and also of the construction of the contact insert 400—will be described with reference to the following figures.

FIG. 9 shows an enlarged perspective view of the contact insert 400 and two of the contact elements 520. With the contact means 100 of FIG. 8, provision may be made to use only one contact element 520. In this connection, FIG. 9 shows (merely) possible installation positions of the contact element 520.

The contact insert 400 has a rectangular central receiving region 405 with cut-outs or recesses 410, 411, 412 for the contact elements 620, 621, 622. On an upper side of the contact insert 400, the central receiving region 405 further has enclosing side walls on its edge. Two recesses 410 are provided for the two contact elements 620, four recesses 411 for the four contact elements 621, and one recess 412 for the six contact elements 622 (cf. also FIG. 12, in which the contact insert 400 is rotated by 180 degrees compared with FIG. 9). With regard to the six contact elements 622, provision is further made to arrange them in their own casing 415 (cf. FIG. 17), which is arranged in the recess 412.

For arranging the contact element 520, the contact insert 400 has one lateral receiving region 420 in each case on two sides of the central receiving region 405. This makes it possible to use the contact insert 400 for two contact arrangements (of contact elements 620, 621, 622) which are symmetrical to each other (i.e. rotated by 180 degrees). The lateral receiving regions 420 also have recesses 423 and enclosing casing walls on the upper side.

On an underside of the contact insert 400, the recesses 410, 411, 412, 423 may further be surrounded by own sections or casing walls of the contact insert 400 which are to be ascribed to the respective recesses 410, 411, 412, 423, as becomes clear in particular with reference to FIG. 5. In this case, provision may also be made for the contact elements 620 (in contrast to the other contact elements) to project out from the corresponding recesses (cf. also FIG. 2).

The contact insert 400 has one slotted-link-shaped cut-out 440 in each case on four edge or corner sections of the central receiving region, which cut-outs will be discussed in greater detail further below. Furthermore, in each case plate-shaped stop elements 425 with rounded edges are provided on two opposing sides of a lateral receiving region 420 adjoining the central receiving region 405 (or on side walls of the central receiving region 405). On the two sides, a receiving region 420 further has, externally, in each case one guide groove 421 which extends perpendicular, which merges into a slot-shaped cut-out 422 in an upper region of the relevant receiving region 420. A guide groove 421 further projects somewhat into a plate-shaped stop element 425, and forms a cut-out there. This configuration of the lateral receiving regions 420 is selected with regard to the contact element 520, which will be discussed in greater detail below.

FIGS. 10 and 11 show the contact element 520 which is insertable into a receiving region 420 of the contact insert 400, in different perspective views. The contact element 520 has a socket contact or socket contact section 530 and a spring contact section 540 which is connected to the socket contact section 530. The socket contact section 530 may have a configuration corresponding to the (MCON) flat female contacts 621 described above. The two contact sections 530, 540 of the contact element 520 can be produced separately from each other and connected together by crimping. To this end, the socket contact section 530 has crimping tabs 532 which may surround a corresponding holding region of the spring contact section 540 as illustrated in FIG. 10. Instead of crimping, the contact sections 530, 540 can also be connected together in a different manner, for example by welding.

The spring contact section 540 has, adjoining the holding region encompassed by the crimping tabs 532, a central flat contact section 541 and a rear section 542 (via a curved or step-shaped section) which is offset parallel thereto. The rear section 542 further adjoins a C-shaped connection section 544 on which two resilient contact sections 545 are arranged. By means of this configuration, the resilient contact sections 545 are arranged laterally from the central contact section 541. The resilient contact sections 545 have, departing from the connection section 544, two planar sections directed somewhat obliquely outwards, and inwards-directed, sections curved in an S-shape in the region of the ends.

Further, as illustrated in FIGS. 10 and 11, a series of latch elements may be provided on the contact element 520. These include raised latch sections or latch projections 531 arranged on both sides on the socket contact 530, and an embossed section 543 on the rear section 542. Such latch elements may be used to latch the contact element 520 in a receiving region 420 of the contact insert 400 (the receiving region 420 having corresponding latch elements, not shown), and also to latch the contact element 510 with the contact element 520 upon insertion thereinto. The contact element 510 can also be provided with raised latch sections 531 as indicated in FIG. 12. Insertion of the contact element 510 into the contact element 520 arranged in a receiving region 420 is carried out before the contact insert 400 is arranged on/in the associated contact-insert region 340 of the casing base part 310.

FIG. 12 shows a further perspective view of the contact insert 400, in which the contact element 520 is arranged in the "front" receiving region 420 of the contact insert 400. Owing to the configuration of the receiving region 420 with the slot-shaped cut-outs 421, the resilient contact sections 545 of the contact element 520 can project laterally partially out of the recess 420. The guide grooves 421 of the receiving region 420 in this case serve to guide the resilient contact sections 545 upon insertion of the contact element 520. Since the guide grooves 421 form small cut-outs in the region of the plate-shaped stop elements 425, the ends of the resilient contact sections 545 can further be fixed (against bending towards or away from each other) at these points.

FIG. 12 further indicates insertion of the contact element 510 connected to the protective conductor 140 into the contact element 520 arranged in the contact insert 400. The contact element 510 or the socket thereof is pushed on to the central flat contact section 541 of the contact element 520, which action causes the flat contact section 541 to be surrounded and an electrical connection between the contact elements 510, 520 to be produced. In order to permit better holding of the pushed-on contact element 510, provision may be made for the contact element 510 to adjoin inner walls of the appropriate receiving region 420 (which have on the outside the guide grooves 421, cf. FIG. 9). The contact element 510 can further be secured against pulling out by corresponding latch elements of the contact elements 510, 520 and of the receiving region 420 (cf. the embossed section 543 and the raised latch section 531 of FIGS. 10, 11 and 12).

The resilient contact sections 545 of the contact element 520 which project laterally out of the receiving region 420 permit contacting of the casing 300 or casing base part 310 when the contact insert 400 is arranged on the contact-insert region 340. As an illustration, a partially sectional view of the casing base part 310 with the contact insert 400 inserted is shown in FIG. 13. The casing base part 310 has (further) casing bores 344 within the contact-insert region 340, the outsides of which bores can be touched by the resilient contact sections 545 and can thus be contacted. The casing base part 310 can further (in the manner described above) be connected electrically to the shield 130 of the cable 110 via the pull relief element 200. This makes an electrical connection between the protective conductor 140 (which contacts the contact element 520 via the contact element 510) and the shield 130 possible even without an additional line 610.

The casing bores 344 illustrated in FIG. 13 may be provided in the casing base part 310, in order to fix contact inserts (not shown) with a different construction from that of the contact insert 400 to the casing base part 310 by means of screws. With regard to the contact insert 400 illustrated, the contact bores 344 together with the stop plates 425 of the contact insert 400 may effect stopping of the contact insert 400 in order to define an end position thereof on/in the contact-insert region 340 of the casing base part 310. Further details of the fastening of the contact insert 400 will be explained in greater detail below with reference to the partially sectional views of FIGS. 14 to 16.

FIG. 14 shows the contact insert 400 (unlike FIGS. 15 and 16, without the contact elements 510, 520) upon being arranged on/in the casing base part 310. The casing base part 310 has, within the contact-insert region 340 on an inner side or inner wall located opposite the casing opening 330, two structural elements 347 (of which merely a "front" structural element 347 is illustrated in FIG. 14). The contact insert 400, as becomes clear in particular with reference to FIGS. 9 and 12, has slotted-link-shaped cut-outs 440 at the "corners" of the central receiving region 405. The cut-outs 440 are rounded off outwards in an upper region, which forms overhanging edges which can be used to hang the contact insert 400 (initially) on the structural elements 347.

To this end, the contact insert 400, as illustrated in FIG. 14, is inserted into the casing base part 310. In this case, the contact insert 400, before reaching the end position (defined by the contact bores 344 of the casing base part 310 and the plate-shaped stop elements 425 of the contact insert 400), is brought into a slightly tipped or tilted position in order to move past the overhanging edge sections of the contact insert 400 above the cut-outs 440 on the structural elements 347. Subsequently, the contact insert 400 is pivoted back in the direction of the inner wall of the casing base part 310 with the structural elements 347, which means that the structural elements 347 are received in the cut-outs 440 (cf. FIG. 15).

Following this, the casing cover 350, as illustrated in FIG. 15, is hung with the claw-shaped holding elements 370 on an edge of the casing opening 330, the holding elements 370 engaging in associated cut-outs 440 of the contact insert 400. In this manner, the contact insert 400 is fixed to the casing base part 310 when the casing cover 350 is closed, as illustrated in FIG. 16.

Once again, the contacting between the resilient contact sections 545 of the contact element 520 and the casing bores 344 of the casing base part 310 becomes clear with reference to the illustration in FIGS. 15 and 16. Furthermore, the resilient contact sections 545, as indicated in FIGS. 15 and 16, may also be used additionally to contact the inserted contact element 510 on the sides. For such a configuration, for example the receiving regions 420 of the contact insert 400 may be modified such that, contrary to the illustration in FIG. 9, no guide grooves 421, but instead continuous cut-outs 422 which extend as far as the plate-shaped stop elements 425 are provided. In this manner, the contact element 510 can be contacted both via the central contact section 541 and via the resilient contact sections 545 of the contact element 520 arranged in the (modified) contact insert 400, which means that optionally a lesser contact resistance can be attained.

The contact elements 510, 520 may be formed such that lateral contacting of the contact element 510 by the resilient contact sections 545 is already brought about by pushing the contact element 510 on to the contact element 520. Alternatively, there is the possibility that lateral contacting of the contact element 510 which is pushed on to the contact element 520 will occur only once the contact insert 400 is arranged in/on the contact-insert region 340 of the casing base part 310, and as a result the casing bores 344 of the casing base part 310 press the resilient contact sections 545 inwards in the direction of the contact element 510.

FIG. 17 shows a perspective exploded view of a further contact means 100 which corresponds substantially to a combination of the configurations of FIGS. 1 and 8. Therefore for features already described which relate to similar or matching components, usable method steps for assembly, possible advantages etc., reference will be made to the above statements.

With the contact means 100 of FIG. 17, the protective conductor 140 of the cable 110 is provided with the annular-contact cable terminal 630. Furthermore, again the additional line 610 is used, with a further annular-contact cable terminal 630 being arranged at one end of the additional line 610 and the contact element 510 at the other end. Also the associated contact element 520 is provided, which can be received in the contact insert 400, and which when the contact insert 400 is arranged on the casing base part 310 can contact the casing base part 310.

This configuration makes it possible to produce an electrical connection between the protective conductor 140 and the casing 300 or casing base part 310 both in the region of the fastening of the pull relief element to the associated casing bore 342 and via the contact elements 520, 510 and the additional line 610. Such multiple contacting can bring about connection in parallel, with the consequence of a reduction in the electrical resistance if a fault current occurs via the protective conductor 140.

FIG. 18 shows a further possible configuration of a pull relief element 201. Further, the use of the pull relief element 201 on a cable 110 with a plurality of lines 145 in an inner chamber 320 of a casing 300 or casing base part 310 becomes clear with reference to the partially sectional illustration of FIG. 19. The contact means 100 illustrated in FIG. 19 (except for the pull relief element 201) may have a construction comparable to the contact means 100 of FIGS. 1, 8 and 17, so for details which relate to similar or matching components, usable method steps for assembly and advantages already described etc., reference is made to the above statements.

The pull relief element 201, like the pull relief element 200 described above, can be manufactured inexpensively in one piece from a metal sheet, and has a substantially two-dimensional pull relief section 221, with the aid of which stable pull relief can be realised. The pull relief section 221, in contrast to the pull relief element 200 described above, is arranged standing perpendicular inside the inner chamber 320 of the casing base part 310. Two planar fastening regions 231, 232 angled vertically from the pull relief section 221 with holes for passing screws 651 through are provided for fastening the pull relief element 201 or the pull relief section 221 thereof, which screws can be screwed into associated casing bores (not shown in FIG. 19).

Between the fastening regions 231, 232, the pull relief section 221 has an arcuate contour adapted to the cable 110 or the periphery thereof, by means of which the cable 110 can be partially encompassed by the pull relief section 221 of the screwed-on pull relief element 201. On the convex contour region of the pull relief section 221 there are further provided piercing mandrels or piercing lugs 235 which cut into the cable sheath 120 of the cable 110, which fixes the cable sheath 120.

The pull relief element 201 furthermore has strip-shaped contacting sections 241 arranged between the piercing lugs 235. The contacting sections 241, which project angled away from the convex contour region of the pull relief section 221, further have a step-shaped course which is adapted to the form of the "step" at the transition between the cable sheath 120 and the exposed region of the shield 130 of the cable 110. Due to the contacting sections 241 which lie in surface-to-surface contact against the shield 130, again two-dimensional and hence reliable contacting of the shield 130 of the cable 110 is made possible. Furthermore, provision may be made for the contacting sections 241 additionally also to be pressed against the shield 130 with the aid of a pressure-application element of the associated casing cover 350.

With regard to the piercing lugs 235, there is the possibility of configuring the piercing lugs 235 of the pull relief element 201 optionally with such dimensions that the piercing lugs 235 completely penetrate the cable sheath 130, and therefore additionally contact the shield 130 of the cable 110 (in addition to the contacting sections 241).

The pull relief section 221 of the pull relief element 201 is furthermore used to realise improved EMC protection or improved EMC shielding of the inner chamber 320 of the casing base part 310. To this end, the two-dimensional pull relief section 221 is used to cover the access opening 315 of the inner chamber 320 (not shown in FIG. 19, cf. for example FIG. 1) or a gap remaining between the cable 110 and the edge of the opening 315, and to lie against a casing wall of the casing base part 310 which surrounds the access opening 315. In this case, the pull relief section 221, as illustrated in FIGS. 18 and 19, can [have] embossed sections or indentations 236 oriented at the casing wall, by means of which embossed sections or indentations the pull relief section 221 can contact the relevant casing wall in localised manner at a plurality of points.

Improved shielding of the inner chamber 320 can also be realised by the pull relief element 202 illustrated in FIG. 20, which can likewise be used or screwed on in an inner chamber 320 of one (of the above-described) contact means 100. The pull relief element 202 has substantially the same construction as the pull relief element 200, and has a clip-shaped pull relief section 222 with two fastening regions 231, 232 and a clip-shaped contacting section 240.

For the purpose of improved shielding, further strip-shaped shield tabs 237 projecting vertically from the pull relief section 222 are provided, with the aid of which the access opening 315 of an inner chamber 320 can likewise be substantially closed. The tabs 237 may correspondingly lie against a casing wall surrounding the access opening 315, and optionally additionally be provided with embossed sections or indentations oriented at the casing wall (not shown).

FIG. 21 shows a further possible configuration of a pull relief element 203, which can likewise be used or screwed on in an inner chamber 320 of one (of the above-described) contact means 100. The pull relief element 203 has substantially the same construction as the pull relief element 200, and has a clip-shaped pull relief section 223 with two fastening regions 231, 232 and a clip-shaped contacting section 240.

Furthermore, an additional flat contact or flat contact section 238 is provided on the fastening region 232. The flat contact 238 can be contacted via a cable terminal 660 which is likewise illustrated in FIG. 21. The cable terminal 660, which is for example what is called a "FASTON contact", further has crimping tabs for fastening a protective conductor 140 and an additional line 610, in order to connect the protective conductor 140 and the additional line 610 (comparably to FIG. 4) to the pull relief element 203 (and hence to a shield 130 of a cable 110 and to a casing 300).

FIGS. 22 and 23 each shown in a perspective view a contact means 100, which is attached to a complementary contact means 700 by way of example ("connector mating part" or "mating plug") and is fastened thereto. The contact means 100 has a construction or components corresponding to the embodiments described above.

The complementary contact means 700, which can for example be arranged on a printed circuit board (not shown), has a rectangular section 701 adapted to the contact-insert region 340 of the contact means 100, which, when the contact means 100 is placed on top as illustrated in FIGS. 22 and 23, is surrounded in an upper region by the contact-insert region 340, and within which complementarily formed contact elements adapted to the contact elements of the contact means 100 are arranged or can be arranged (not shown). With regard to the female contact elements or socket contacts of the contact means 100 which are described above, corresponding male contact elements or pin contacts may be provided for the contact means 700, which elements or contacts, when the contact means 100 is placed upon the contact means 700, are inserted into the contact elements of the contact means 100 or contact them.

In addition to the section 701, the contact means 700 further has, adjoining the section 701, a two-dimensional section 702 which surrounds the edge of the section 701 in a lower region. The planar section 702 may serve as a bearing surface or base for the contact means 700.

Also the contact means 700 or the sections 701, 702 thereof may have an electrically conductive or metallic material for shielding purposes, the section 701, when the contact means 100 is placed on the contact means 700, being able to be contacted by the casing base part 310 or the contact-insert region 340 thereof.

In addition to the sections 701, 702, the complementary contact means 700 has a locking stirrup 710, with the aid of which the contact means 100 which is connected to the contact means 700 can be fixed. The locking stirrup 710, which has a form which partly engages around the contact-insert region 340 with two substantially triangular two-dimensional locking sections 711 extending parallel to each other, is mounted rotatably or pivotably on the section 701 of the contact means 700. To this end, the section 701 has a circular or cylindrical raised section 705 in each case on two opposing sides. The locking sections 711 of the locking stirrup 710 have corresponding circular cut-outs 705 which in the assembled state of the locking stirrup 710 shown in FIGS. 22 and 23 surround the raised sections 715 on the section 701 of the contact means 700. The locking stirrup 710 may be mounted on the contact means 700 either in the arrangement shown in FIG. 22 or alternatively in the opposite or symmetrical arrangement shown in FIG. 23.

The locking sections 711 of the locking stirrup 710 further have (above), offset relative to the cut-outs 715, semicircular or slotted-link-shaped recesses 714, open on one side, which with regard to the latch stirrups 314 of the contact means 100 are formed or matched thereto. When the contact means 100 is placed upon the contact means 700, the locking stirrup 710 can be pivoted out of an initial position (not shown) in the direction of the contact means 100 or of the contact-insert region 340, the locking sections 711 engaging the latch stirrups 314 of the contact means 100 via the recesses 714, and the contact means 100 as a result being fixed to the contact means 700. To detach the fixing, the locking stirrup 711 can be pivoted away from the contact means 100, which (again) releases the latch stirrups 314.

In order to facilitate the pivoting of the locking stirrup 710, the locking stirrup 710 further has, on a section which connects the locking sections 711, an angled actuating section 717 which will be referred to below as actuating lever 717.

In the arrangement illustrated in FIG. 22, the section of the locking stirrup 710 and hence the actuating lever 717 which connects the locking sections 711 is located on the same side as the covering cap 160 or the cable leaving at this point from the contact means 100 (not shown in FIG. 22). Owing to the angled shape of the contact means 100, the actuating lever 717 in this case is covered substantially by the contact means 100 or by the casing base part 310 thereof and the covering cap 160 thereof, which means that the locking stirrup 710 can be protected from unintentional actuation. In this configuration, provision may further be made for it to be possible to actuate the locking stirrup 710 substantially only via a tool. In contrast, the actuating lever 717 in the arrangement illustrated in FIG. 23, in which the actuating lever 717 is located on the side opposite the "cable exit", is not covered by the contact means 100, and hence is freely accessible for manual actuation.

The embodiments of contact means 100 and their components explained with reference to the figures represent preferred embodiments, or embodiments by way of example, of the invention. In addition to the embodiments described and illustrated, further embodiments which may comprise further modifications or combinations of the features described are conceivable.

In particular, pull relief elements with a different construction may be realised. One example of a possible modification is to provide the pull relief elements 202, 203 of FIGS. 20 and 21, corresponding to the pull relief element 200, with embossed sections 233 on the respective pull relief sections 222, 223 and/or cut holes 234 with cutting-in edges.

With regard to the pull relief element 200, the embossed section 203 and/or the cut hole 234 may also be omitted. Without a cut hole or a cutting-in edge, the corresponding pull relief section may merely clamp a cable sheath 120.

One further possible modification consists for example in omitting the sections 241 from the pull relief element 201 of FIG. 18, and merely providing piercing lugs 235. In this case, the piercing lugs 235 may contact a shield 130 of a cable 110 (through a cable sheath 120), and therefore act as contacting sections.

Furthermore, pull relief elements with more than one embossed section and/or cut hole, [or] with different forms of embossed section and/or cut hole are conceivable. Also, pull relief and/or contacting sections of pull relief elements with other than the forms and structures shown, and in different numbers, may be realised on the pull relief elements.

Further, there is the possibility of fastening pull relief elements to a casing in a different manner than with the aid of screws 651. For example, it is possible to effect fastening with a screw only on one side of a pull relief element or pull relief section, and on another side to provide for insertion in or latching with a structural element of a casing or casing base part. Such a type of fastening may for example be realised similarly to the hooking-in of the contacting section 240 on the structural element 327 illustrated in FIG. 7. Furthermore, fastening of a pull relief element may also be provided entirely without screws, by latching the pull relief element for example on two sides on a casing.

Also with regard to the assembly method stated above, modifications are possible, for example by carrying out method steps in a different sequence. With regard to a method, it is further possible to provide a contact insert 400 preassembled with an additional line 610 or a contact element 520. Furthermore, it is conceivable not to connect a protective conductor 140 of a cable 110 to a shield 130 of the cable 110, so that a shield tap permitted via a pull relief element merely serves to connect the shield 130 electrically to a casing 300.

Furthermore, different casings or casing forms may be considered for contact means. For example, with regard to the casing base part 310 it is possible to replace the contact bores 344 (cf. FIG. 13) by other structures or casing walls, against which the stop elements 425 of a contact insert 400 can lie, and which can be contacted by resilient contact sections 545 of a contact element 520.

It is also possible to use casing parts made from/with other materials instead of metallic casing parts or casing parts produced by means of die-casting methods (i.e. casing base part 310 and casing cover 350). For example, it is possible to use plastics material as material for the casing base part 310 and/or the casing cover 350. In order (furthermore) to effect shielding of an inner chamber with such casing parts, the casing parts may be metallically coated, for example by carrying out a galvanic or electrochemical deposition operation. This also applies to the complementary contact means 700.

Other casing forms may likewise determine possible (alternative) forms of pull relief elements. For example, a casing base part with a lateral casing opening which can be closed by a casing cover may, instead of the angled form of the casing base part 310 shown, have a straight form (which means that an access opening of an inner chamber and a contact-insert opening can be arranged opposite one another). With such a straight form, a cable received in an inner chamber may have a straight course. In this respect, a pull relief element may have a pull relief section and a contacting section which, (unlike FIG. 2), are oriented parallel to one another. With regard to further alternative casing forms, for example configurations with two casing halves which can be connected together may also be considered.

Furthermore, it is possible, instead of the contact insert 400 illustrated, to use other contact inserts with a different construction. Further, also the socket contacts and contact elements 620, 621, 622, 510, 520 illustrated in the figures are to be regarded merely as possible examples of contact elements which can optionally be replaced by other contact elements or contact sections. For example, it is conceivable to use male contact sections, i.e. for example contact pins, pin-shaped contact sections, tab-shaped/tongue-shaped (flat) contact sections etc. instead of (female) contact sections with female plugs and (flat) female contacts.

With regard to the contact elements 510, 520 and in particular the contact element 520, it is further pointed out that such contact elements 510, 520 can also be used for other contact means 100 than the contact means illustrated, or independently of the contact means 100 and also with regard to other applications. Further, the contact elements 510, 520 which can be contacted together, as indicated above, may also have other forms than those illustrated and described. In this regard, a contact element with the following features which corresponds to the contact element 520 can be outlined:

contact element, having a central contact section (comparably to the contact section 541) and two resilient contact sections (comparably to the sections 545) arranged by the central contact section.

In this case, the resilient contact sections are used in order to connect the contact element arranged in a contact insert electrically with other components (for example a casing), the contact insert being able to be arranged on these components. The contact insert in question may have a construction corresponding to the contact insert 400 described above, or comprise at least one receiving region for the contact element. The receiving region can be provided with cut-outs (comparably to the cut-outs 422), through which the resilient contact sections can partially project out.

Furthermore, the resilient contact sections may also be used to contact a further contact element (comparably to the contact element 520), which can be contacted with the contact element previously described via the central contact section, and additionally also via the resilient contact sections. Such contacting via the resilient contact sections can already be realised when the two contact elements are connected together. Alternatively, contacting via the resilient contact sections may not occur until the resilient contact sections are pressed in the direction of the further contact element, for example if the contact element arranged in a contact insert with the resilient contact sections is arranged on a further component.

With regard to further (possible) details and features of the two contact elements which can be plugged together, reference is made to the above statements, in particular to FIGS. 10 and 11.

Furthermore, it is pointed out that the complementary contact means 700 illustrated in FIGS. 22 and 23 can also be realised in a different or modified configuration. For example, it is possible to form the locking stirrup 710 illustrated with a different form, or to realise locking of a contact means 100 on a complementary contact means 700 with different components.

The invention claimed is:

1. A contact means for attaching an end of a cable, having:

a casing with an inner chamber for receiving a section of the cable in the region of the cable end, a pull relief element which can be fastened to the casing in the inner chamber, with a pull relief section and at least one contacting section, the pull relief section being formed to fix a cable sheath of the cable, and the contacting section being formed to contact a shield of the cable;

a contact insert, a first contact element which can be arranged in the contact insert, and a second contact element which can be connected to a line, the first and second contact elements being able to be plugged together to produce an electrical connection, and the first contact element having a central contact section and two resilient contact sections arranged laterally from the central contact section.

2. A contact means according to claim 1, the pull relief section of the pull relief element being able to be fastened to the casing at two fastening points in order partially to encompass the cable which is provided between the fastening points by the pull relief section.

3. A contact means according to claim 1, the pull relief section of the pull relief element being formed to clamp in the cable sheath of the cable and/or to cut into the cable sheath.

4. A contact means according to claim 1, the contacting section of the pull relief element being formed to lie on an exposed region of the shield of the cable.

5. A contact means according to claim 1, the casing having a structural element in the inner chamber by means of which the contacting section of the pull relief element can be pressed against an exposed region of the shield of the cable.

6. A contact means according to claim 1, the casing having an access opening for the cable on the inner chamber, and the pull relief element having a section which is formed to lie against a casing wall, which surrounds the access opening, of the casing.

7. A contact means according to claim 1, the casing having a casing base part and a casing cover, the casing base part comprising the inner chamber and having a casing opening which exposes the inner chamber, and the inner chamber of the casing base part being able to be closed by the casing cover.

8. A contact means according to claim 7, the casing cover having a pressure-application structure which is formed to press the contacting section of the pull relief element, when the inner chamber is closed, against an exposed region of the shield of the cable.

9. A contact means according to claim 7, having a contact insert and at least one contact element which can be arranged in the contact insert and can be connected to a line of the cable, the casing base part having a contact-insert region with an opening for arranging the contact insert, the casing cover having claw-shaped holding elements, by means of which the casing cover can be fastened to an edge when closing the inner chamber, and the contact insert having cut-outs into which the claw-shaped holding elements of the casing cover can be engaged upon the fastening, in order to fasten the contact insert to the casing base part.

10. A contact means according to claim 1, the line to which the second contact element can be connected being one of the following components:

an additional line which is provided for a connection to a protective conductor of the cable via the pull relief element, or a protective conductor of the cable.

11. A contact means according to claim 1, the contact insert having a receiving region for the first contact element, the receiving region having cut-outs through which the resilient contact sections of the first contact element which is arranged in the receiving region partially project out, so that the resilient contact sections contact the casing when the contact insert is arranged on the casing.

12. A contact means according to claim 11, the contact insert having one receiving region for the first contact element in each case on two sides.

13. A cable, having a cable sheath, a shield and a contact means for attaching an end of the cable according to claim 1.

14. A cable according to claim 13, the cable having a protective conductor, the protective conductor being electrically connected to the shield of the cable.

* * * * *